US012668981B2

(12) United States Patent
Boo et al.

(10) Patent No.: US 12,668,981 B2
(45) **Date of Patent: *Jun. 30, 2026**

(54) BUILDING PANEL WITH A MECHANICAL LOCKING SYSTEM

(71) Applicant: Välinge Innovation AB, Viken (SE)

(72) Inventors: Fredrik Boo, Kågeröd (SE); Anders Nilsson, Helsingborg (SE); Karl Quist, Höganäs (SE)

(73) Assignee: VÄLINGE INNOVATION AB, Viken (SE)

( * ) Notice: Subject to any disclaimer, the term of this patent is extended or adjusted under 35 U.S.C. 154(b) by 209 days.

This patent is subject to a terminal disclaimer.

(21) Appl. No.: 18/635,607

(22) Filed: Apr. 15, 2024

(65) Prior Publication Data

US 2025/0075512 A1 Mar. 6, 2025

Related U.S. Application Data

(63) Continuation of application No. 17/697,334, filed on Mar. 17, 2022, now Pat. No. 11,987,992.

(30) Foreign Application Priority Data

Mar. 19, 2021 (SE) ..... 2150322-2

(51) Int. Cl.
*E04F 15/02* (2006.01)
*E04F 13/08* (2006.01)
*E04G 23/00* (2006.01)

(52) U.S. Cl.
CPC .... *E04F 15/02038* (2013.01); *E04F 13/0894* (2013.01); *E04F 2201/0146* (2013.01);
(Continued)

(58) Field of Classification Search
CPC ..... E04F 15/02038; E04F 13/0894; E04F 2201/0146; E04F 2201/023; E04F 2201/042; E04F 2201/043; E04F 2201/044
See application file for complete search history.

(56) References Cited

U.S. PATENT DOCUMENTS 7,051,486 B2 5/2006 Pervan
7,454,875 B2 11/2008 Pervan et al.
(Continued)

FOREIGN PATENT DOCUMENTS

EP 3146126 B1 12/2019
EP 3140555 B1 3/2021
(Continued)

OTHER PUBLICATIONS

U.S. Appl. No. 19/191,513, Christian Boo, filed Apr. 28, 2025.
(Continued)

*Primary Examiner* — Gisele D Ford
(74) *Attorney, Agent, or Firm* — Boone IP Law

(57) ABSTRACT

A set of panels each including a main surface, a first edge, an opposite second edge, a third edge which is adjacent to the first edge and a fourth edge which is opposite to the third edge. The set includes a mechanical locking device which is configured to lock the first edge to the second edge. The locking device includes a flexible tongue. The flexible tongue includes a central part configured to cooperate with a tongue groove for locking. A first edge part and the tongue groove are configured such that when in the locked position a force P' is applied adjacent the first edge and the third edge of the first panel and another force P is applied adjacent the second edge and the third edge of the second panel, the first edge part is pushed towards a bottom surface of an insertion groove which allows a disassembling.

20 Claims, 17 Drawing Sheets

(52) U.S. Cl.
CPC ... *E04F 2201/023* (2013.01); *E04F 2201/042* (2013.01); *E04F 2201/043* (2013.01); *E04F 2201/044* (2013.01); *E04G 23/006* (2013.01)

(56) References Cited

U.S. PATENT DOCUMENTS 7,584,583 B2 9/2009 Bergelin et al.
7,634,884 B2 12/2009 Pervan et al.
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan et al.
7,841,144 B2 11/2010 Pervan
7,841,145 B2 11/2010 Pervan et al.
7,841,150 B2 11/2010 Pervan
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,041 B2 7/2011 Pervan et al.
8,033,074 B2 10/2011 Pervan et al.
8,042,311 B2 10/2011 Pervan et al.
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan et al.
8,713,886 B2 5/2014 Pervan et al.
8,733,065 B2 5/2014 Pervan
8,733,410 B2 5/2014 Pervan
8,763,341 B2 7/2014 Pervan
8,769,905 B2 7/2014 Pervan et al.
8,776,473 B2 7/2014 Pervan et al.
8,806,832 B2 8/2014 Kell
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Darko et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Darko
9,091,077 B2 7/2015 Boo
9,103,126 B2 8/2015 Kell
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan et al.
9,359,774 B2 6/2016 Pervan
9,366,036 B2 6/2016 Pervan
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan et al.
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelov
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo et al.
10,828,798 B2 11/2020 Fransson
10,933,592 B2 3/2021 Blomgren et al.
10,934,721 B2 3/2021 Pervan et al.
10,953,566 B2 3/2021 Fransson et al.
10,968,639 B2 4/2021 Pervan et al.
10,975,577 B2 4/2021 Pervan et al.
10,995,501 B2 5/2021 Pervan
11,045,933 B2 6/2021 Fransson et al.
11,053,691 B2 7/2021 Pervan
11,053,692 B2 7/2021 Pervan
11,060,302 B2 7/2021 Ylikangas et al.
11,066,835 B2 7/2021 Boo
11,078,673 B2 8/2021 Pervan et al.
11,091,920 B2 8/2021 Kell
11,131,099 B2 9/2021 Pervan
11,174,646 B2 11/2021 Pervan
11,193,283 B2 12/2021 Pervan et al.
11,261,608 B2 3/2022 Pervan
11,274,453 B2 3/2022 Pervan
11,326,353 B2 5/2022 Nilsson et al.
11,331,824 B2 5/2022 Myllykangas et al.
11,358,301 B2 6/2022 Fransson
11,365,546 B2 6/2022 Ylikangas et al.
11,408,181 B2 8/2022 Pervan
11,479,976 B2 10/2022 Ylikangas et al.
2004/0016196 A1 1/2004 Pervan
2005/0160694 A1 7/2005 Pervan
2005/0210810 A1 9/2005 Pervan
2006/0070333 A1 4/2006 Pervan

(56) References Cited

U.S. PATENT DOCUMENTS

2006/0101769 A1 5/2006 Pervan et al.
2006/0236642 A1 10/2006 Pervan
2006/0260254 A1 11/2006 Pervan
2008/0000186 A1 1/2008 Pervan et al.
2008/0000187 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan et al.
2008/0104921 A1 5/2008 Pervan et al.
2008/0110125 A1 5/2008 Pervan
2008/0134607 A1 6/2008 Pervan et al.
2008/0134613 A1 6/2008 Pervan
2008/0134614 A1 6/2008 Pervan et al.
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1 5/2009 Pervan et al.
2009/0193748 A1 8/2009 Boo et al.
2010/0293879 A1 11/2010 Pervan et al.
2010/0300031 A1 12/2010 Pervan et al.
2010/0319290 A1 12/2010 Pervan et al.
2010/0319291 A1 12/2010 Pervan et al.
2011/0030303 A1 2/2011 Pervan et al.
2011/0041996 A1 2/2011 Pervan
2011/0088344 A1 4/2011 Pervan et al.
2011/0088345 A1 4/2011 Pervan
2011/0154763 A1 6/2011 Bergelin et al.
2011/0167750 A1 7/2011 Pervan
2011/0225922 A1 9/2011 Pervan et al.
2011/0252733 A1 10/2011 Pervan et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan et al.
2012/0174520 A1 7/2012 Pervan
2012/0279161 A1 11/2012 Hakansson et al.
2013/0008117 A1 1/2013 Pervan
2013/0014463 A1 1/2013 Pervan
2013/0019555 A1 1/2013 Pervan et al.
2013/0042562 A1 2/2013 Pervan et al.
2013/0042563 A1 2/2013 Pervan et al.
2013/0042564 A1 2/2013 Pervan et al.
2013/0042565 A1 2/2013 Pervan et al.
2013/0047536 A1 2/2013 Pervan
2013/0081349 A1 4/2013 Pervan et al.
2013/0111845 A1 5/2013 Pervan et al.
2013/0145708 A1 6/2013 Pervan
2013/0160391 A1 6/2013 Pervan et al.
2013/0232905 A2 9/2013 Pervan
2013/0239508 A1 9/2013 Darko et al.
2013/0263454 A1 10/2013 Boo et al.
2013/0263547 A1 10/2013 Boo
2013/0318906 A1 12/2013 Pervan et al.
2014/0007539 A1 1/2014 Pervan et al.
2014/0020324 A1 1/2014 Pervan
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Darko
2014/0109506 A1 4/2014 Pervan et al.
2014/0123586 A1 5/2014 Pervan et al.
2014/0190112 A1 7/2014 Pervan et al.
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0366476 A1 12/2014 Pervan et al.
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0252573 A1 9/2015 Devos
2015/0267419 A1 9/2015 Darko
2015/0300029 A1 10/2015 Pervan
2015/0330088 A1 11/2015 Derelov
2015/0337537 A1 11/2015 Boo
2015/0368910 A1 12/2015 Kell
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelov
2017/0037641 A1 2/2017 Nygren et al.
2017/0081860 A1 3/2017 Boo
2017/0089379 A1 3/2017 Pervan
2017/0254096 A1 9/2017 Pervan
2017/0321433 A1 11/2017 Pervan et al.
2017/0362834 A1 12/2017 Pervan et al.
2018/0001509 A1 1/2018 Myllykangas et al.
2018/0001510 A1 1/2018 Fransson
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan
2018/0119429 A1 5/2018 Schulte
2018/0119431 A1 5/2018 Pervan et al.
2018/0178406 A1 6/2018 Fransson et al.
2019/0024387 A1 1/2019 Pervan
2019/0048592 A1 2/2019 Boo
2019/0048596 A1 2/2019 Pervan
2019/0063076 A1 2/2019 Boo et al.
2019/0093370 A1 3/2019 Pervan et al.
2019/0093371 A1 3/2019 Pervan
2019/0119928 A1 4/2019 Pervan et al.
2019/0127989 A1 5/2019 Kell
2019/0127990 A1 5/2019 Pervan et al.
2019/0169859 A1 6/2019 Pervan et al.
2019/0232473 A1 8/2019 Fransson et al.
2019/0271165 A1 9/2019 Boo
2019/0376298 A1 12/2019 Pervan et al.
2019/0394314 A1 12/2019 Pervan et al.
2020/0087927 A1 3/2020 Pervan
2020/0102756 A1 4/2020 Pervan
2020/0109569 A1 4/2020 Pervan
2020/0149289 A1 5/2020 Pervan
2020/0173175 A1 6/2020 Pervan
2020/0181923 A1 6/2020 Quist et al.
2020/0224430 A1 7/2020 Ylikangas et al.
2020/0263437 A1 8/2020 Pervan
2020/0284045 A1 9/2020 Kell
2020/0318667 A1 10/2020 Peter
2020/0354969 A1 11/2020 Pervan et al.
2020/0412852 A9 12/2020 Pervan et al.

(56) References Cited

U.S. PATENT DOCUMENTS

| | | | |
|---|---|---|---|
| 2021/0016465 | A1 | 1/2021 | Fransson |
| 2021/0047840 | A1 | 2/2021 | Pervan |
| 2021/0047841 | A1 | 2/2021 | Pervan et al. |
| 2021/0071428 | A1 | 3/2021 | Pervan |
| 2021/0087831 | A1 | 3/2021 | Nilsson et al. |
| 2021/0087832 | A1 | 3/2021 | Boo |
| 2021/0087833 | A1 | 3/2021 | Ylikangas et al. |
| 2021/0087834 | A1 | 3/2021 | Ylikangas et al. |
| 2021/0310257 | A1 | 10/2021 | Boo |
| 2021/0348396 | A1 | 11/2021 | Pervan et al. |
| 2021/0381255 | A1 | 12/2021 | Ylikangas et al. |
| 2022/0025657 | A1 | 1/2022 | Pervan |
| 2022/0025658 | A1 | 1/2022 | Kell |
| 2022/0143718 | A1 | 5/2022 | Pervan et al. |
| 2023/0235571 | A1 | 7/2023 | Larsson et al. |

FOREIGN PATENT DOCUMENTS

| | | | |
|---|---|---|---|
| WO | 2007/015669 | A2 | 2/2007 |
| WO | 2014/209213 | A1 | 12/2014 |
| WO | 2020/145862 | A1 | 7/2020 |

OTHER PUBLICATIONS

International Preliminary Report on Patentability received for PCT Patent Application No. PCT/SE2022/050255, mailed on Sep. 28, 2023, 11 pages.

International Search Report and Written Opinion received for PCT Patent Application No. PCT/SE2022/050255 mailed on May 3, 2022, 16 pages.

U.S. Appl. No. 18/963,840, Anders Nilsson, filed Nov. 29, 2024.

U.S. Appl. No. 19/221,987, Roger Ylikangas, filed May 29, 2025.

U.S. Appl. No. 19/014,541, Fredrik Boo, filed Jan. 9, 2025.

U.S. Appl. No. 19/221,907, Christian Boo, filed May 29, 2025.

U.S. Appl. No. 17/697,334, Fredrik Boo, filed Mar. 17, 2022.

U.S. Appl. No. 18/069,320, Lucas Larsson, filed Dec. 21, 2022.

U.S. Appl. No. 18/313,110, Darko Pervan, filed May 5, 2023.

U.S. Appl. No. 18/222,449, Christian Boo, filed Jul. 16, 2023.

U.S. Appl. No. 18/242,312, Roger Ylikangas, filed Sep. 5, 2023.

U.S. Appl. No. 18/370,443, Fredrik Boo, filed Sep. 20, 2023.

U.S. Appl. No. 18/370,454, Anders Nilsson, filed Sep. 20, 2023.

U.S. Appl. No. 19/174,449, Lucas Larsson, filed Apr. 9, 2025.

U.S. Appl. No. 19/642,984, Lucas Larsson, filed Apr. 9, 2026.

BUILDING PANEL WITH A MECHANICAL LOCKING SYSTEM

CROSS REFERENCE TO RELATED APPLICATIONS

The present application is a continuation of U.S. application Ser. No. 17/697,334, filed on Mar. 17, 2022, which claims the benefit of Swedish Application No. 2150322-2, filed on Mar. 19, 2021. The entire contents of U.S. application Ser. No. 17/697,334 and Swedish Application No. 2150322-2 are hereby incorporated herein by reference in their entirety.

TECHNICAL FIELD

Embodiments of the present invention relates to panels, such as a building panels, floorboards, wall panels, ceiling panels, furniture components or the like, which comprise a mechanical locking system.

TECHNICAL BACKGROUND

Building panels provided with a mechanical locking system comprising a displaceable and resilient tongue cooperating with a tongue groove for vertical locking is known and disclosed in, e.g., WO2014209213 and WO2020/145862. The tongue is a separate part and is made of, e.g., plastic and inserted in a displacement groove at an edge of a panel. The tongue is pushed into the displacement groove during a vertical assembling of the panels and springs back into the tongue groove of an adjacent panel when the panels have reached a locked position.

A drawback with the known mechanical systems is that the panels are requires a tool for an easy disassemble.

The above description of various known aspects is the applicant's characterization of such, and is not an admission that any of the above description is considered as prior art.

SUMMARY

It is an object of certain embodiments of the present invention to provide an improvement over the above described techniques and known art. Particularly, disassembling of panels comprising the known locking system is improved by embodiments of the invention.

At least some of these and other objects and advantages that will be apparent from the description have been achieved by a first aspect of the invention that comprises a set of panels, such as building panels, which comprises a first panel and a second panel each comprising a main surface, a first edge an opposite second edge a third edge which is adjacent and optionally perpendicular to the first edge and a fourth edge which is opposite to the third edge. The set comprises a mechanical locking device which is configured to lock the first edge of the first panel to the second edge of the second panel at a joint seam. The locking device comprises a flexible tongue, which is positioned in an insertion groove at the first edge of the first panel and a tongue groove at the second edge of the second panel, wherein the flexible tongue is of an elongated shape and the length direction is parallel to the first edge, wherein the flexible tongue comprises a central part between a first edge part and a second edge part of the flexible tongue. The central part is configured to cooperate with the tongue groove for a locking of the first and the second edge in a first direction which is perpendicular to the main surface in a locked position of the first panel and the second panel.

The first edge part and the tongue groove are configured such that when in the locked position a force is applied adjacent the first edge and the third edge of the first panel and another force is optionally applied adjacent the second edge and the third edge of the second panel, the first edge part is pushed towards a bottom surface of the insertion groove which allows a disassembling of the second panel from the first panel by displacing the third edge of the second panel relative the third edge of the first panel.

An advantage may be that first panel and the second panel may be easily disassembled. A further advantage may be that first panel and the second panel may be disassembled without a tool and or applying a force with a tool.

The mechanical locking may be configured such that the when the third edge of the second panel is displaced relative the third edge of the first panel the central part is pushed towards the bottom surface of the insertion groove such that the mechanical locking device is unlocked.

The first panel and the second panel may be essentially identical.

The force and the another force may be applied in a direction which is opposite to the first direction.

The force may be applied at a distance from the joint seam and at a distance from an upper and outermost part of the third edge of the first panel.

The another force may be applied at a distance from the joint seam and at a distance from an upper and outermost part of the third edge of the second panel.

The first panel may be configured to bend around an axis which is parallel to an outermost part of the first edge of the first panel when the force is applied and/or the second panel may be configured to bend around an axis which is parallel to an outermost part of the first edge of the second when the force is applied.

The first edge part may comprise at a first edge a flexible part and a recess, wherein the flexible part is configured to be displaced towards a bottom surface of the recess during assembling and disassembling of the first and the second panel, wherein the first edge part may comprise at a second edge, which is opposite to the first edge, a curved surface, wherein an axis of the curved surface is essentially perpendicular to an upper surface of the first edge part, wherein the curved surface extends at least partly over the recess.

The curved surface may have in an unlocked position a first length in a length direction of the flexible tongue and when the force and the another force is applied a second length in a length direction of the flexible tongue, wherein the second length is greater than first length.

The curved surface in the locked position may be configured to be pushed by the flexible part towards the tongue groove.

The first edge part may comprise a protruding part adjacent the curved surface. The protruding part may prevent or counteract that the first edge part is rotated relative the insertion groove during assembling and disassembling.

The force may be applied at the first edge of the first panel and adjacent the curved surface.

The first edge part may comprise at a first edge a guiding surface which is configured to cooperate with the tongue groove when the force and the another force are applied such that the second edge is displaced towards the insertion groove.

The flexible tongue may be configured to bend in the length direction when the guiding surface cooperates with the tongue groove when the second edge is displaced towards the insertion groove such that a bent tongue part is obtained with a bent outer edge.

The bent outer edge may be configured as a guiding surface which cooperates with the tongue groove and/or edge surface of the second panel such that the central part is pushed towards the bottom surface of the insertion groove and the mechanical locking device is unlocked.

The central part may comprise at a first edge a flexible part and a recess, wherein the flexible part is configured to be displaced towards a bottom surface of the recess during assembling and disassembling of the first and the second panel, wherein a wherein the first central part comprises at a second edge, which is opposite to the first edge, an essentially straight surface, wherein the second edge is configured to cooperate with the tongue groove for the locking of the first and the second edge in the first direction.

The second edge of the central part may comprise a locking edge which is configured to cooperate with a locking surface of the tongue groove for the locking of the first and the second edge in the first direction.

The second edge of the central part may comprise a locking recess adjacent the locking edge.

The locking recess may comprise a first recess surface adjacent the locking edge and a second recess surface, wherein the first recess surface extends at an acute angle to a centreline of the flexible tongue. An advantage may be that the locking strength is increased.

The first panel may be configured to bend around an axis which is parallel to an outermost part of the third edge of the second panel when the third edge of the second panel is displaced relative the third edge of the first panel.

The thickness of the panels may be in the range of about 3 mm to about 15 mm, and preferably in the range of about 4 mm to about 8 mm.

The mechanical locking device may comprise a first locking strip, at the first edge or at the opposite second edge, provided with a first locking element which is configured to cooperate with a first locking groove at the other of the first or the second edge for a locking in a second direction which is perpendicular to the first direction.

The mechanical locking device may comprise a second locking strip, at the third or the fourth edge, provided with a second locking element which is configured to cooperate with a second locking groove at the other of the third or fourth edge (5 of an adjacent third panel for a locking in a third direction which is perpendicular to the first direction.

The mechanical locking device at the third and the fourth edge may be configured for an assembling and/or a disassembling by an angling motion, wherein a tongue at the third or the fourth edge is positioned in a tongue groove at the other of the third or the fourth edge.

A second aspect of the invention is a flexible tongue which is configured to lock a first edge first panel to a second edge second panel wherein the flexible tongue is configured to be positioned in an insertion groove at the first edge of the first panel and to cooperate with a tongue groove at the second edge of the second panel. The flexible tongue is of an elongated shape and the length direction is parallel to the first edge, wherein the flexible tongue comprises a central part between a first edge part and a second edge part of the flexible tongue, wherein the central part is configured to cooperate with the tongue groove for the locking of the first and the second edge. The first edge part comprises at a first edge a flexible part and a recess, wherein the flexible part is configured to be displaced towards a bottom surface of the recess during assembling and disassembling of the first and the second panel, wherein the first edge part comprises at a second edge, which is opposite to the first edge, a curved surface, wherein an axis of the curved surface is essentially perpendicular to an upper surface of the first edge part. The curved surface extends at least partly over the recess.

The curved surface may have in an unlocked position a first length in a length direction of the flexible tongue and in the locked position a second length in a length direction of the flexible tongue, wherein the second length is greater than first length.

The curved surface in the locked position may be configured to be pushed by the flexible part towards the tongue groove.

The first edge part may comprise at a first edge a guiding surface which is configured to cooperate with the tongue groove when a force and is applied adjacent the first edge of the first panel and/or another force is applied adjacent the second edge of the second panel 1 such that the second edge is guided toward the insertion groove.

The flexible tongue may be configured to be bent in the length direction when the guiding surface cooperates with the tongue groove when the force and the another force are applied such that the central part is pushed towards the bottom surface of the insertion groove and the mechanical locking device is unlocked.

The central part may comprise at a first edge a flexible part and a recess, wherein the flexible part is configured to be displaced towards a bottom surface of the recess during assembling and disassembling of the first and the second panel, wherein the first central part comprises at a second edge, which is opposite to the first edge, an essentially straight surface, wherein the second edge is configured to cooperate with the tongue groove for the locking of the first and the second edge in the first direction.

The second edge of the central part may comprise a locking edge which is configured to cooperate with a locking surface of the tongue groove for the locking of the first and the second edge in the first direction.

The second edge of the central part may comprise a locking recess adjacent the locking edge.

The locking recess may comprise a first recess surface adjacent the locking edge and a second recess surface, wherein the first recess surface extends at an acute angle to a centreline of the flexible tongue.

A third aspect of the invention is method for disassembling a set of panels, such as building panels, which comprises a first panel and a second panel each comprising a main surface, a first edge, an opposite second edge, a third edge which is adjacent, and optionally perpendicular, to the first edge and a fourth edge which is opposite to the third edge. The set comprises a mechanical locking device which is configured to lock the first edge of the first panel to the second edge of the second panel at a joint seam J, wherein the locking device comprises a flexible tongue, which is positioned in an insertion groove at the first edge of the first panel and a tongue groove at the second edge of the second panel. The flexible tongue is of an elongated shape and the length direction is parallel to the first edge. The flexible tongue comprises a central part between a first edge part and a second edge part of the flexible tongue. The central part is configured to cooperate with the tongue groove for locking of the first and the second edge in a first direction which is perpendicular to the main surface in a locked position of the first panel and the second panel, wherein the method comprises applying a force adjacent the first edge and adjacent the third edge of the first panel, optionally applying another force adjacent the second edge and adjacent the third edge of the second panel, whereby displacing the first edge part towards a bottom surface of the insertion groove, and.

disassembling of the second panel from the first panel by displacing the third edge of the second panel relative the third edge of the first panel.

The method may comprise further displacing the third edge of the second panel relative the third edge of the first panel whereby displacing the central part towards the bottom surface of the insertion groove such that the mechanical locking device is unlocked.

The method may comprise applying the force and the another force simultaneously or applying the force and the force alternately.

The method may comprise applying the force and the another force two or more times.

The first panel and the second panel may be essentially identical.

The method may comprise applying the force and the another force in a direction which is opposite to the first direction.

The method may comprise applying the force at a distance from the joint seam and at a distance from an upper and outermost part of the third edge of the first panel.

The method may comprise applying the another force at a distance from the joint seam and at a distance from an upper and outermost part of the third edge of the second panel.

The method may comprise the bending the first panel to around an axis which is parallel to an outermost part of the first edge of the first panel when the force is applied and/or bending the second panel around an axis which is parallel to an outermost part of the first edge of the second when the force is applied.

The method may comprise bending the first panel around an axis which is parallel to an outermost part of the third edge of the second panel when the third edge of the second panel is displaced relative the third edge of the first panel.

The third aspect may comprise the set according to the first aspect and/or the tongue according to the second aspect.

The first panel and the second panel may be resilient panels. The resilient panels may comprise a core comprising a polymer material, such as a thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The first panel and the second panel may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The first panel and the second panel may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

Embodiments of the disclosure may be particularly advantageous for panels comprising locking surfaces with higher friction.

The first and the second panel may comprise a wood-based core, such as HDF, MDF or plywood.

BRIEF DESCRIPTION OF THE DRAWINGS

These and other aspects, features and advantages of which embodiments of the disclosure are capable of, will be apparent and elucidated from the following description of embodiments of the present disclosure, reference being made to the accompanying drawings, in which.

DETAILED DESCRIPTION

Figure 1A:
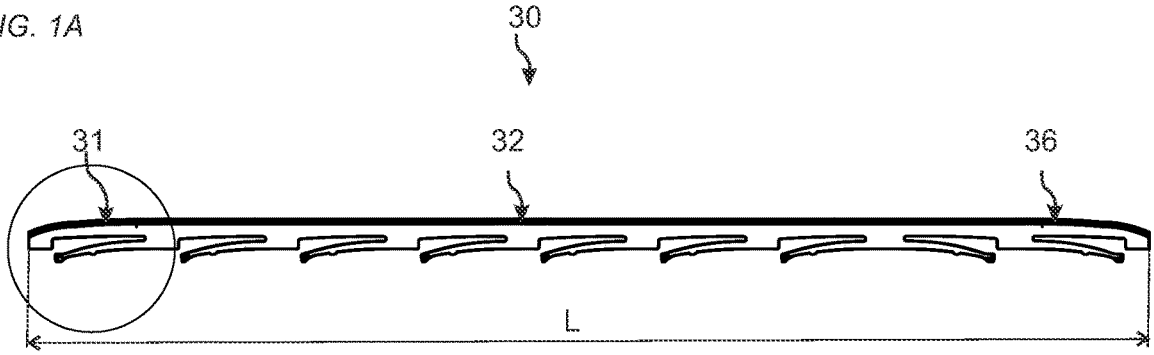
FIGS. 1A-1D show an embodiment of the tongue according to the invention.
Figure 1B:
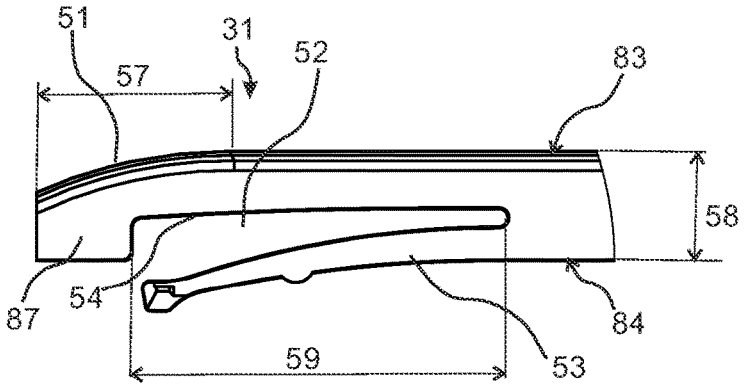
Figure 1C:
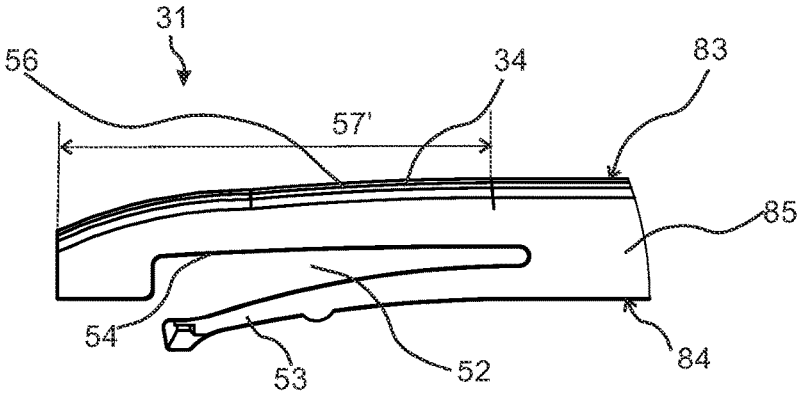
Figure 1D:
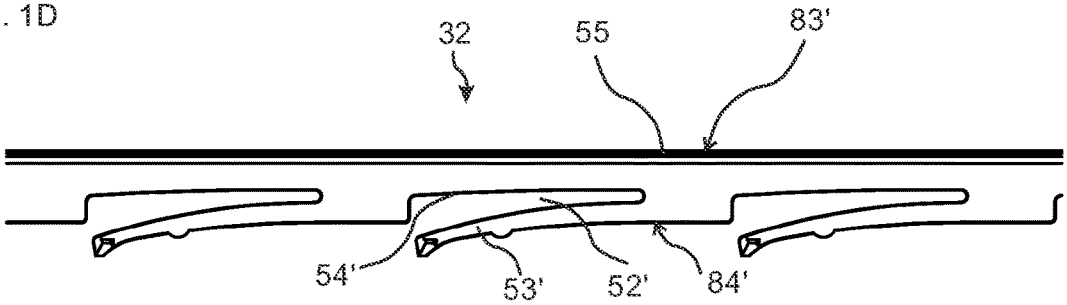

Specific embodiments of the disclosure will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the disclosure to those skilled in the art. The terminology used in the detailed description of the embodiments illustrated in the accompanying drawings is not intended to be limiting of the invention. In the drawings, like numbers refer to like elements.

When the word "about" is used in this specification in connection with a numerical value, it is intended that the associated numerical value include a tolerance of +/−10% around the stated numerical value.

An embodiment of a flexible tongue 30 for a mechanical locking device for a first and a second panel is shown in FIGS. 1A-1D. The flexible tongue 30 is of an elongated shape with a length L. The flexible tongue comprises a central part 32 between a first edge part 31 and a second edge part 36 of the flexible tongue 30. The central part 32 is configured to cooperate with a tongue groove 20 for the locking of a first and a second panel edge of the first and the second panel, respectively in a first direction. The first edge part 31 comprises at a first edge 84 a flexible part 53 and a recess 52, wherein the flexible part is configured to be displaced towards a bottom surface 54 of the recess 52 during assembling and disassembling of the first and the second panel 1, 1'.The first edge part 31 comprises at a second edge 83, which is opposite to the first edge, a curved surface 51, wherein an axis of the curved surface 51 is essentially perpendicular to an upper surface 85 of the first edge part 31, wherein the curved surface 51 extends at least partly over the recess 52. For example, the second edge 83 may have an inflection point over the recess 52.

The first panel 1 and the second 1' panel may be essentially identical; for example, essentially structurally and mechanically identical.

The curved surface 51 may in an unlocked position have a first length 57 in a length direction of the flexible tongue and during disassembling a second length 57' in a length direction of the flexible tongue, wherein the second length 57' is greater than first length 57, such as at least 10% greater, such as at least 40% greater, such as at least 100% greater.

The recess 52 may have a recess length 59 in the length direction of the flexible tongue. The first length 57 of the curved part may extend over a part of the recess length 59, such as from 0 to 50% of recess length 59.

The second length 57' of the curved part may be substantially over the whole recess length 59, such as over at least 90% of the recess length 59, or over at least 95% of the recess length 59.

The curved surface 51 may in the locked position be configured to be pushed by the flexible part 53 towards the tongue groove 20.

The first edge part 31 may comprise at a first edge 84 a guiding surface 34 which is configured to cooperate with the tongue groove such that the second edge 83 is displaced towards the insertion groove 40.

The first edge part 31 may comprise a protruding part 87 adjacent the curved surface 51. The protruding part may prevent or counteract that the first edge part is rotated relative the insertion groove during assembling and disassembling.

The flexible tongue 30 may be configured to bend in the length direction when the second edge 83 is displaced towards the insertion groove 40 such that a bent tongue part is obtained with a bent outer edge which may be configured as a guiding surface which cooperates with the tongue groove 20 and/or an edge surface 25 of the second panel 1' such that the central part 32 is pushed towards the bottom surface 43 of the insertion groove 40 and the mechanical locking device is unlocked.

The central part 32 may comprise, at a first edge 84', a flexible part 53' and a recess 52', wherein the flexible part is configured to be displaced towards a bottom surface 54 of the recess 52 during assembling and disassembling of the first and the second panel 1, 1', wherein the first central part 32 comprises at a second edge 83', which is opposite to the first edge, an essentially straight surface 55, wherein the second edge 83' is configured to cooperate with the tongue groove 20 for the locking of the first and the second edge in a first direction D1.

The second edge 83' of the central part 32 may comprise a locking edge 35 which is configured to cooperate with a locking surface 21 of the tongue groove 20 for the locking of the first and the second edge in the first direction D1.

The second edge 83' of the central part 32 may comprise a locking recess 38 adjacent the locking edge 35.

Figure 4A:
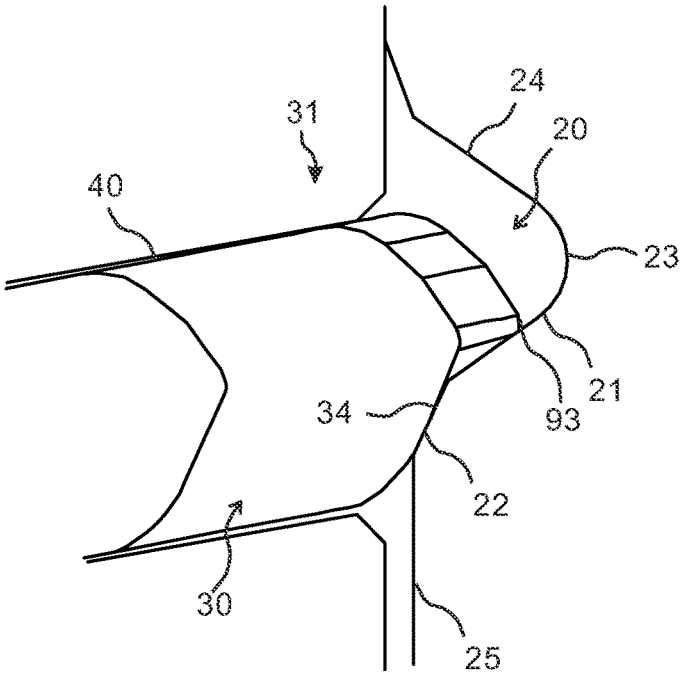
FIGS. 4A-4B show an enlarged cross section of a part of the set panels shown in FIGS. 2A-2C.
Figure 4B:
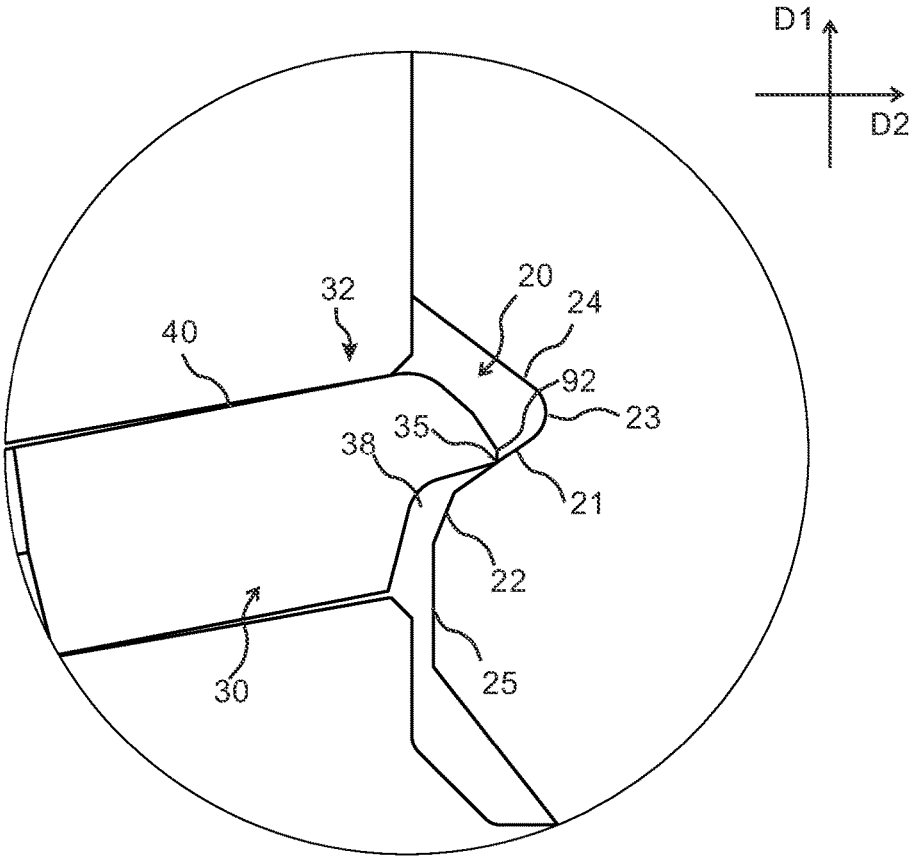
Figure 5A:
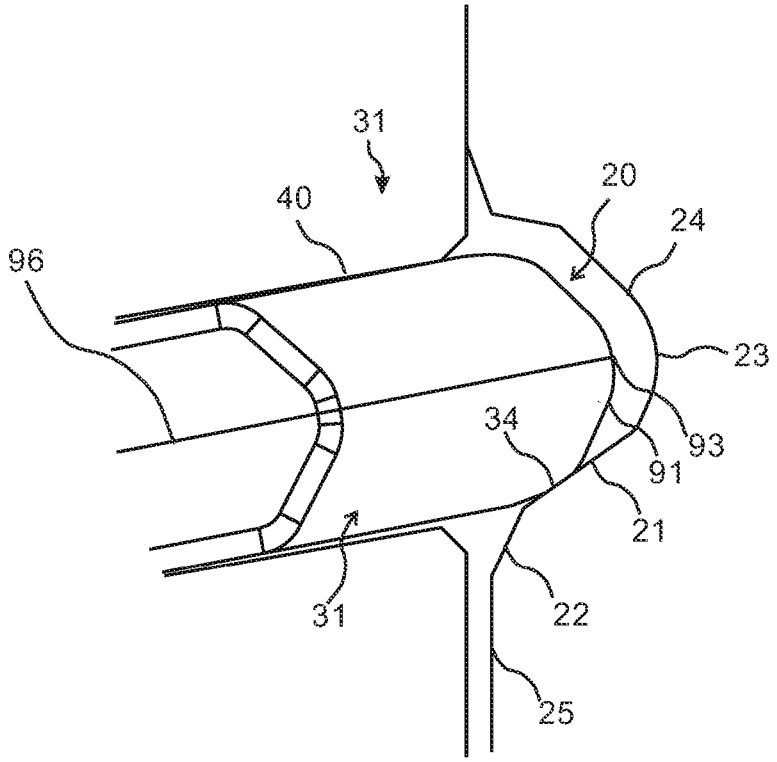
FIGS. 5A-5B show an enlarged cross section of a part of the set panels shown in FIGS. 3A-3B.
Figure 5B:
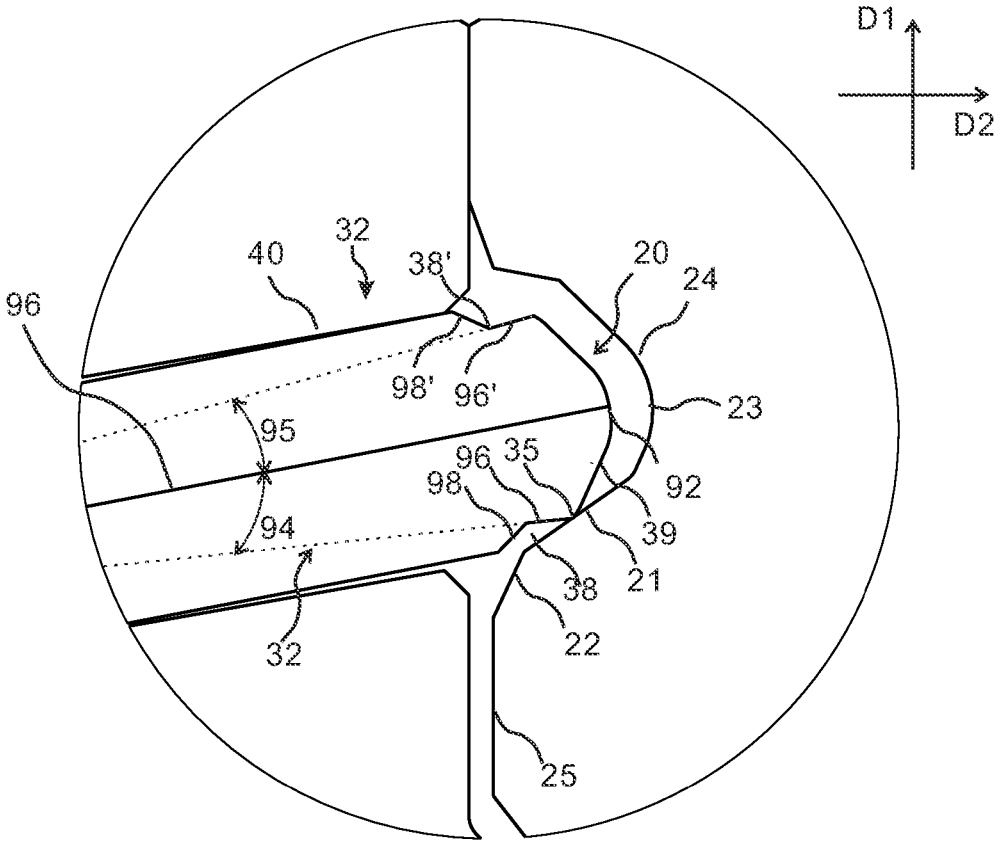

Embodiments of the set of panels according to the invention are shown in a locked position in cross section views in FIG. 2A-5B. The embodiments comprise a set of panels, such as building panels, which comprises a first panel 1 and a second panel 1'. Each panel may comprise a main surface 17, an opposite and parallel surface 19, a first edge 4*a*, an opposite second edge 4*b*, a third edge 5*a* which is adjacent and optionally perpendicular to the first edge 4*a* and a fourth edge 5*b* which is opposite to the third edge 5*a* as shown in FIG. 6B.

The set comprises a mechanical locking device which is configured to lock the first edge of the first panel to the second edge of the second panel at a joint seam J, wherein the locking device comprises a flexible tongue 30, which is positioned in an insertion groove 40 at the first edge 4*a* of the first panel and a tongue groove 20 at the second edge 4*b* of the second panel 4*b*, wherein the flexible tongue 30 is of an elongated shape and the length direction is parallel to the first edge 4*a*.

The flexible tongue comprises a central part 32 between a first edge part 31 and a second edge part 36 of the flexible tongue 30, wherein the central part 32 is configured to cooperate with the tongue groove 20 for locking of the first and the second edge in a first direction D1 which is perpendicular to the main surface 17 in a locked position of the first panel 1 and the second panel 1'.

Figure 13:
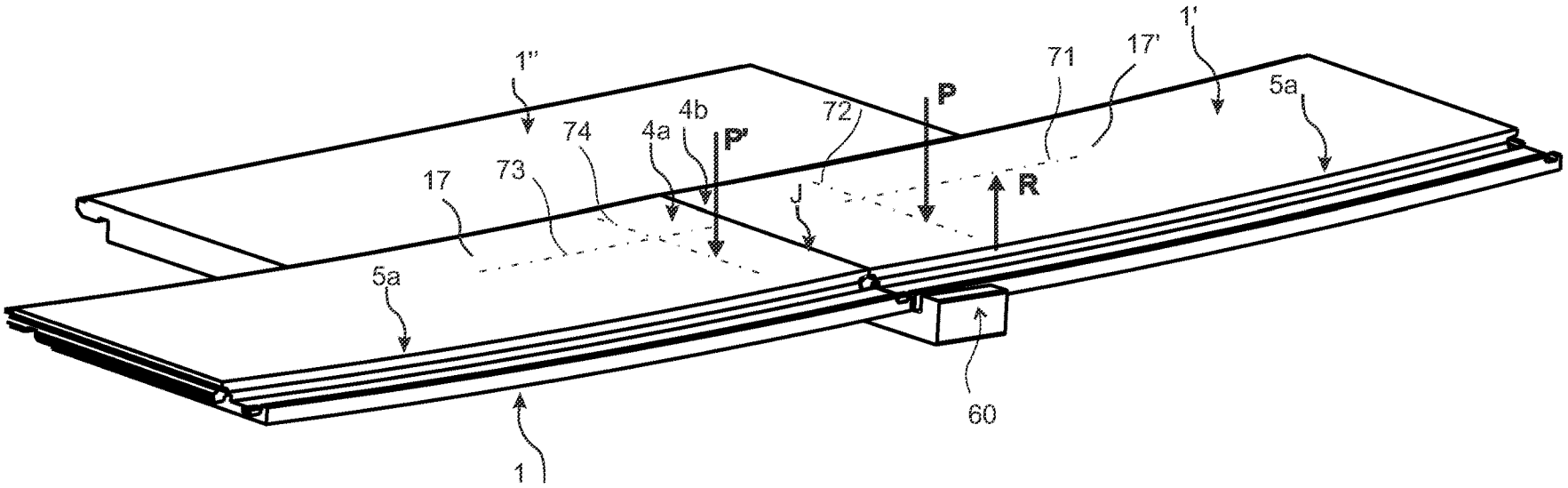
FIG. 13 shows an embodiment of the set during disassembling according to an embodiment of the invention.
Figure 14A:
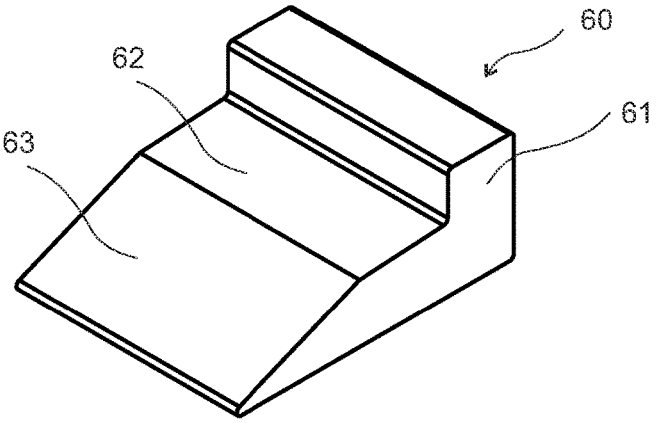
FIG. 14A shows an embodiment of a raising element according to an embodiment of the invention.
Figure 14B:
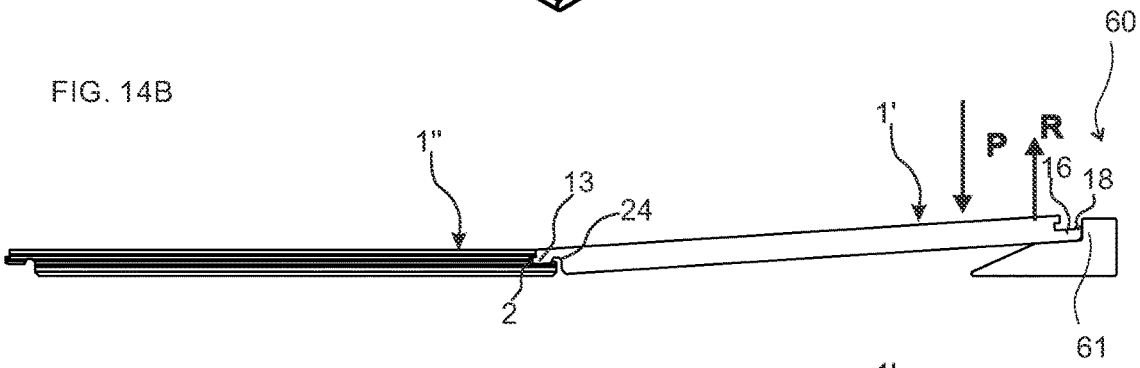
FIG. 14B-14D show an embodiment of the set during disassembling according to an embodiment of the invention.
Figure 14C:
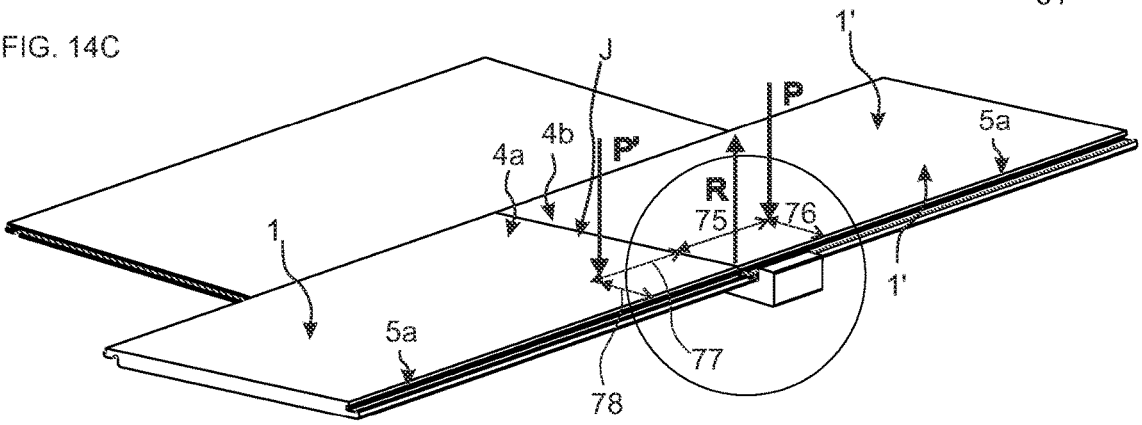
Figure 14D:
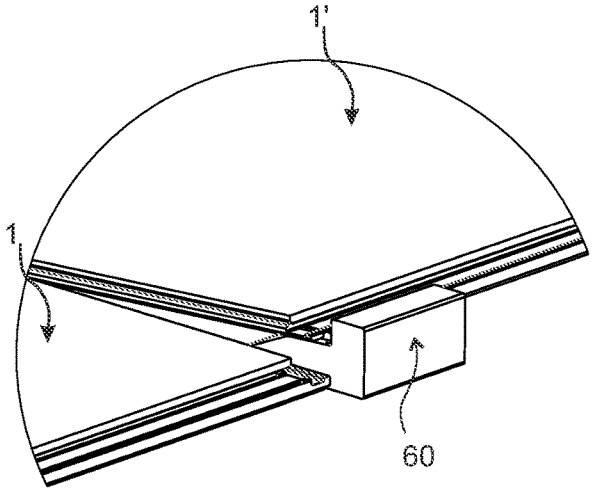
Figure 15A:
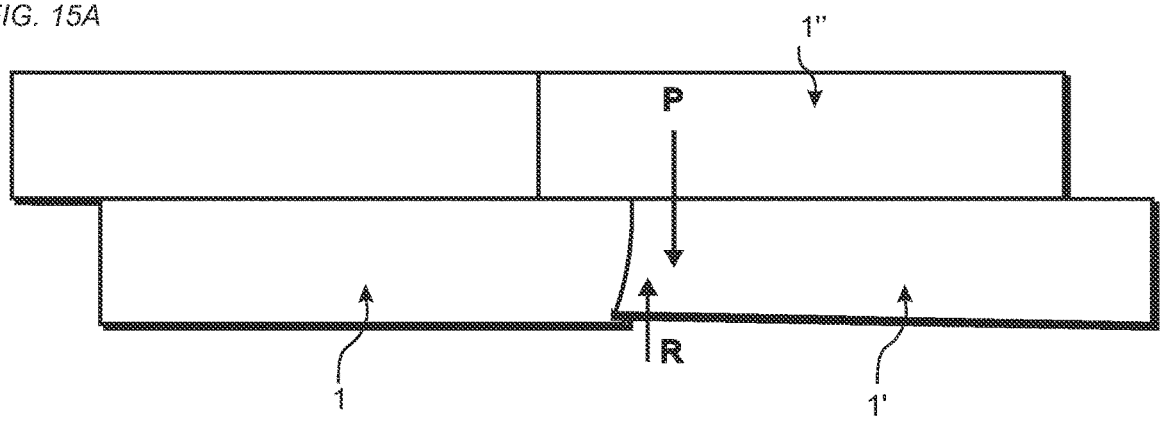
FIG. 15A-15B show an embodiment of the set during disassembling according to an embodiment of the invention.
Figure 15B:
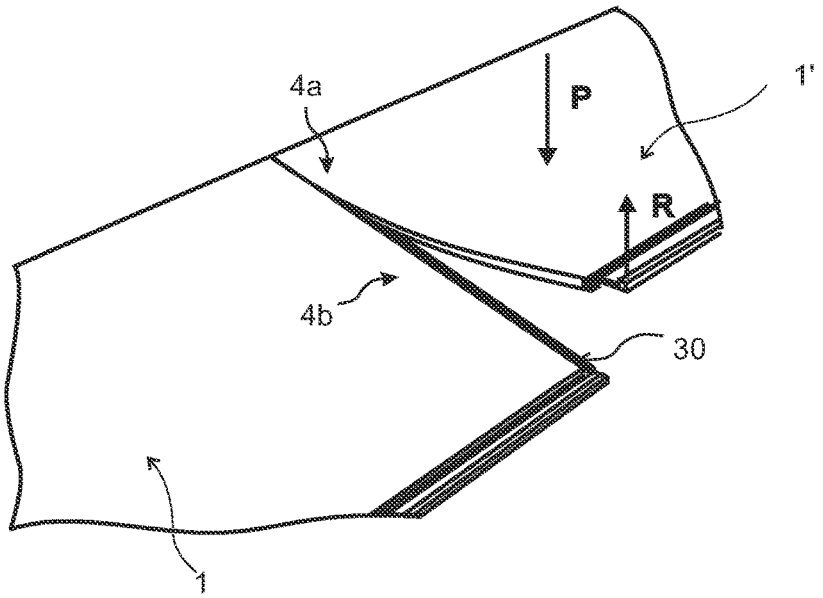
Figure 16A:
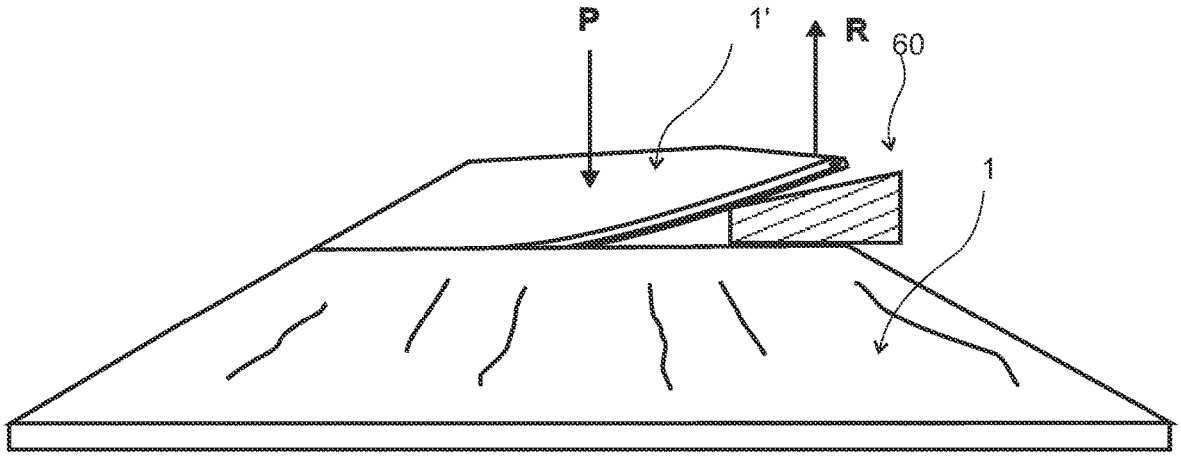
FIG. 16A-16B show an embodiment of the set during disassembling according to an embodiment of the invention.
Figure 16B:
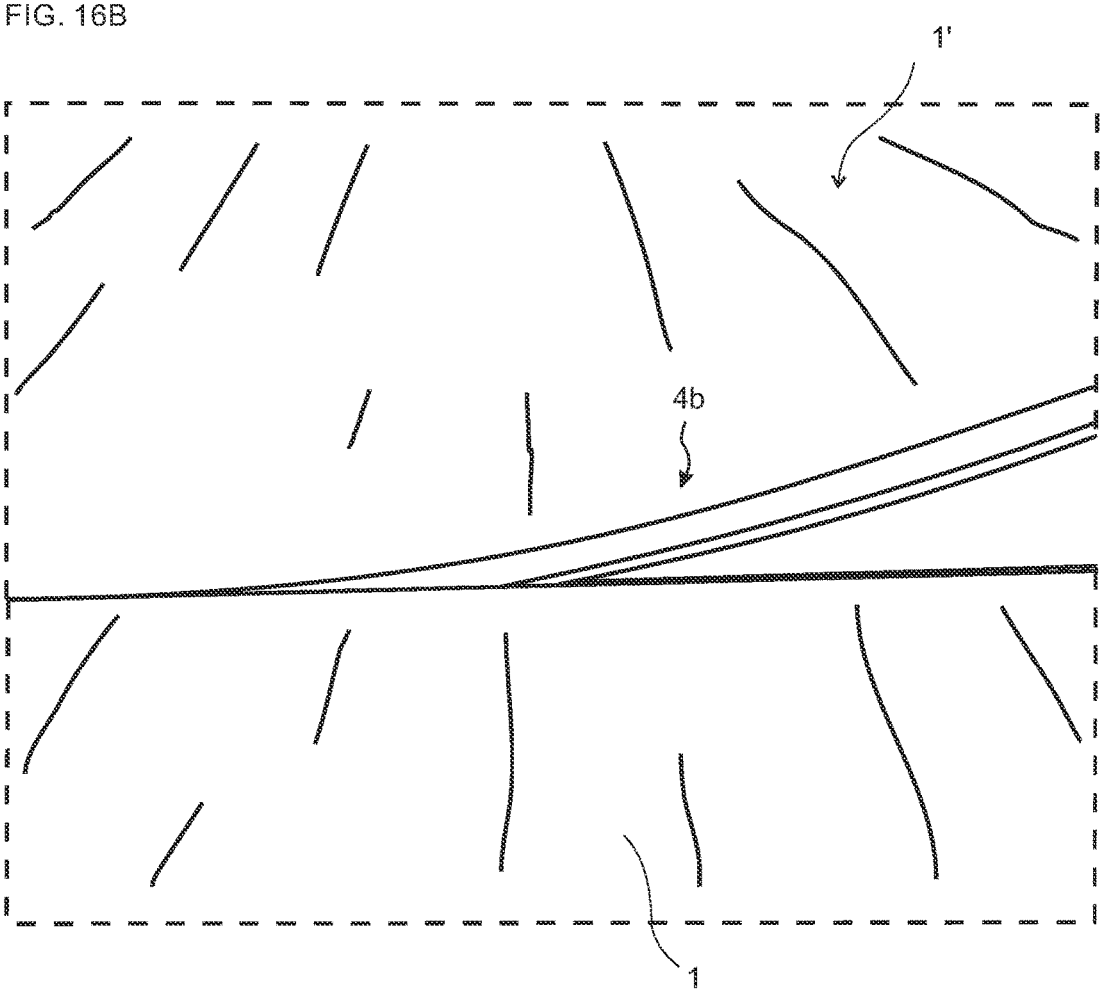

The first edge part 31 and the tongue groove 20 are configured such that when in the locked position a force P' is applied adjacent the first edge 4*a* and adjacent the third edge 5*a* of the first panel and optionally another force P is applied adjacent the second edge 4*b* and adjacent the third edge 5*a* of the second panel 1', as shown in FIGS. 13 and FIGS. 14B-14C, the first edge part 31 is pushed towards a bottom surface 43 of the insertion groove 40 which allows a disassembling of the second panel 1' from the first panel 1 by displacing R the third edge 5*a* of the second panel 1' relative the third edge 5*a* of the first panel 1.

The force P' and the another force P may be applied in a direction which is opposite to the first direction D1.

The force P' may be applied at the first edge 4*a* of the first panel 1 and adjacent the curved surface 51.

The insertion groove 40 may comprise a groove surface 41 and an opposite groove surface 42 and a bottom surface 43 extending between the groove surface 41 and the opposite groove surface 42.

The flexible tongue 30 may be configured according to the flexible tongue shown and described in relation to FIGS. 1A-1D.

The tongue groove 20 may comprise a locking surface 21 and an opposite tongue groove surface 24 and bottom surface 23 extending between the locking surface 21 and the opposite tongue groove surface 24.

The tongue groove 20 may comprise a groove guiding surface 22 which may be positioned adjacent the locking surface 21 and at an opening of the tongue groove 20.

The central part 32 of the flexible tongue 30 may comprise a locking edge 35 which is configured to cooperate with the locking surface 21 of the tongue groove 20 for the locking of the first and the second edge in the first direction D1.

The central part 32 of the flexible tongue 30 may comprise a locking recess 38 adjacent the locking edge 35. The locking recess 38 may increase the locking force between the locking edge 35 and the locking surface 21.

The second panel 1' may comprise an edge surface 25 adjacent the guiding surface 22. The edge surface 25 may extend in a direction which is essentially parallel with the first direction.

The locking device may comprise a first locking strip 6, at the first edge 4*a* or at the opposite second edge 4*b*, provided with a first locking element 8 which may be configured to cooperate with a first locking groove 14 at the other of the first or the second edge 4*a*,4*b* for a locking in a second direction D2 which is perpendicular to the first direction D1.

Figure 7:
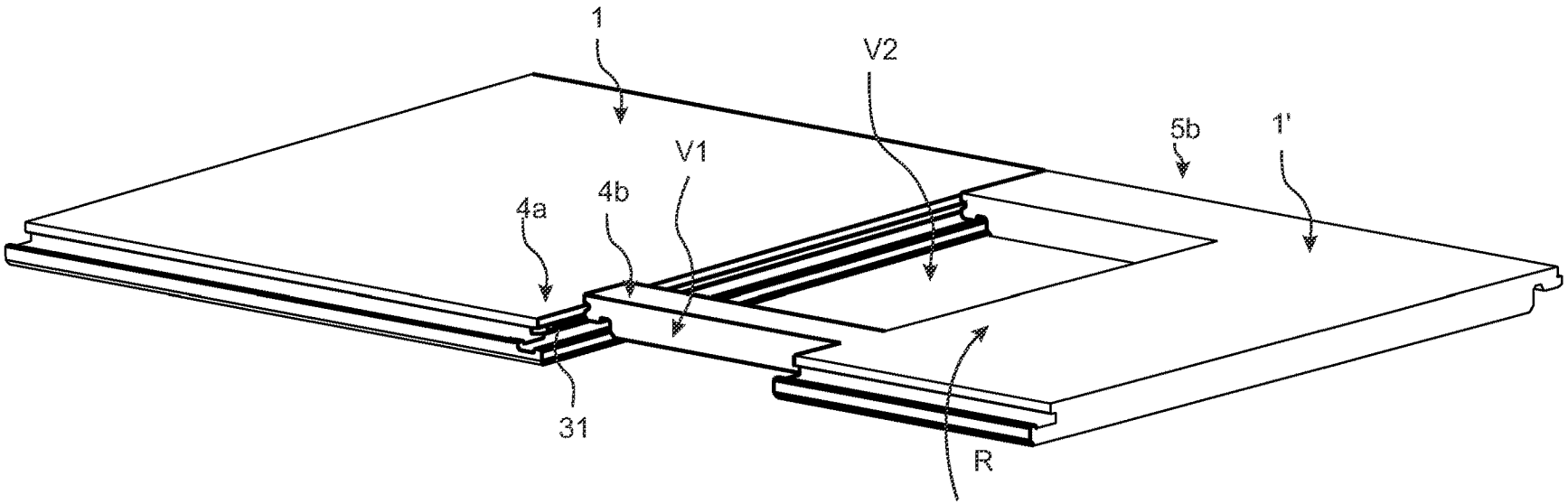
FIG. 7 shows an embodiment of the set during disassembling according to an embodiment of the invention.
Figure 8A:
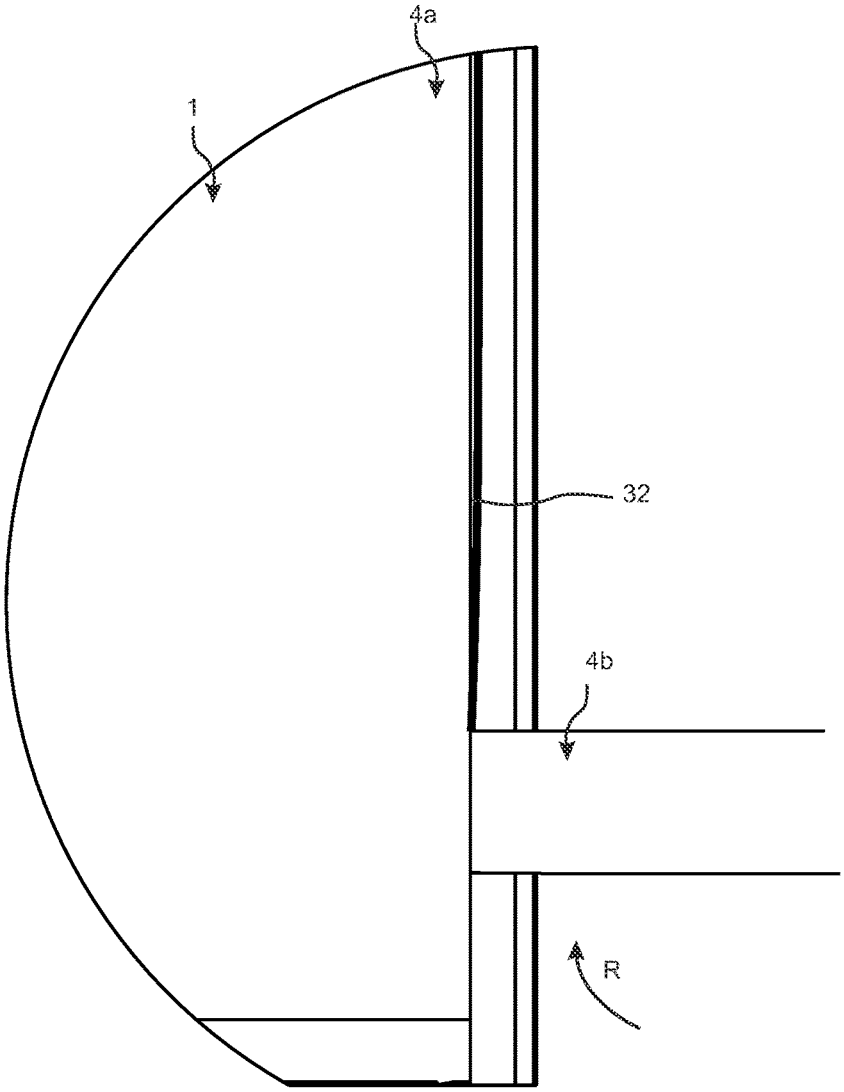
FIG. 8A shows an enlargement of a part of the set as shown in FIG. 7.

The mechanical locking device may be configured such that flexible tongue 30 bend in the length direction when the second edge 83 of the first edge part 31 is displaced towards the insertion groove 40 such that a bent tongue part is obtained with a bent outer edge which is illustrated in FIG. 7 and FIG. 8A which is an enlargement of a part of the set shown in FIG. 7. In FIGS. 7-8A parts V1, V2 of the first panel 1 are made transparent in order to visualize the displacement and bending of the flexible tongue 30.

The bent outer edge may be configured as a guiding surface which cooperates with the tongue groove 20, e.g. the groove guiding surface 22 and/or the locking surface 21, and/or an edge surface 25 of the second panel 1' such that the central part 32 is pushed towards the bottom surface 43 of the insertion groove 40 and the mechanical locking device is unlocked.

The position on the flexible tongue of the bent outer edge moves along the first edge 4*b* during the displacement R of the third edge 5*a* of the second panel 1' relative the third edge 5*a* of the first panel 1. During an initial displacement the bent outer edge is adjacent the first edge part 31 and at the end of the displacement the bent outer edge may be adjacent the second edge part 32. The mechanical locking device may be unlocked at the end of the displacement such that the first panel 1 may be disassembled from the second panel 1'.

Figure 8B:
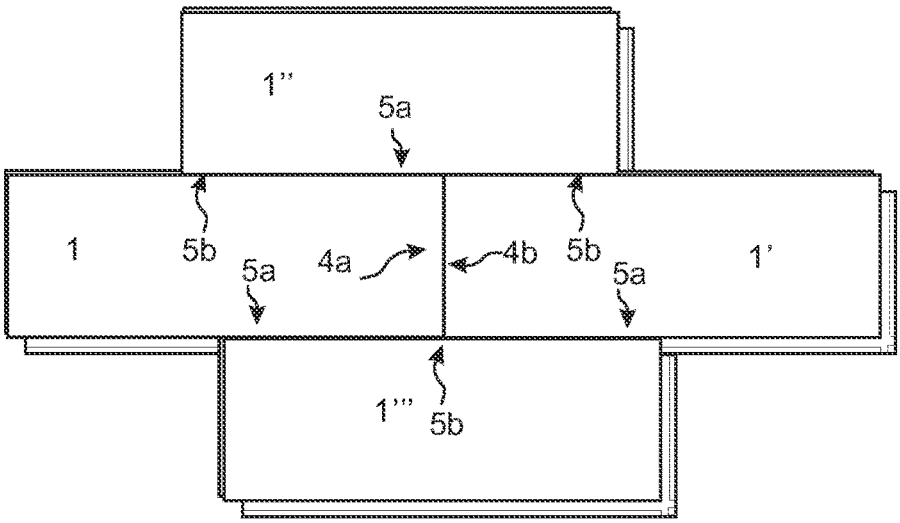
FIG. 8B show a set including four assembled panels in a locked position.

FIG. 8B shows a set of four essentially identical panels 1, 1', 1''', 1''' in an assembled and locked position. The first edge 4*a* of the first panel 1 is locked to the second edge 4*b* of the second panel 1'. The fourth edge 5*b* of the second panel 1' and the fourth edge 5*b* of the first panel 1 are locked to a third edge 5*a* of an adjacent panel 1'' in an adjacent row. The third edge 5*a* of the second panel 1' and the third edge 5*a* of the first panel 1 are locked to a fourth edge 5*b* of an adjacent panel 1''' in an adjacent new row. The fourth edge 5*b* of the adjacent panel 1''' in the adjacent new row may counteract or prevent the displacement R of the third edge 5*a* of the second panel 1' relative the third edge 5*a* of the first panel 1.

Figure 2A:
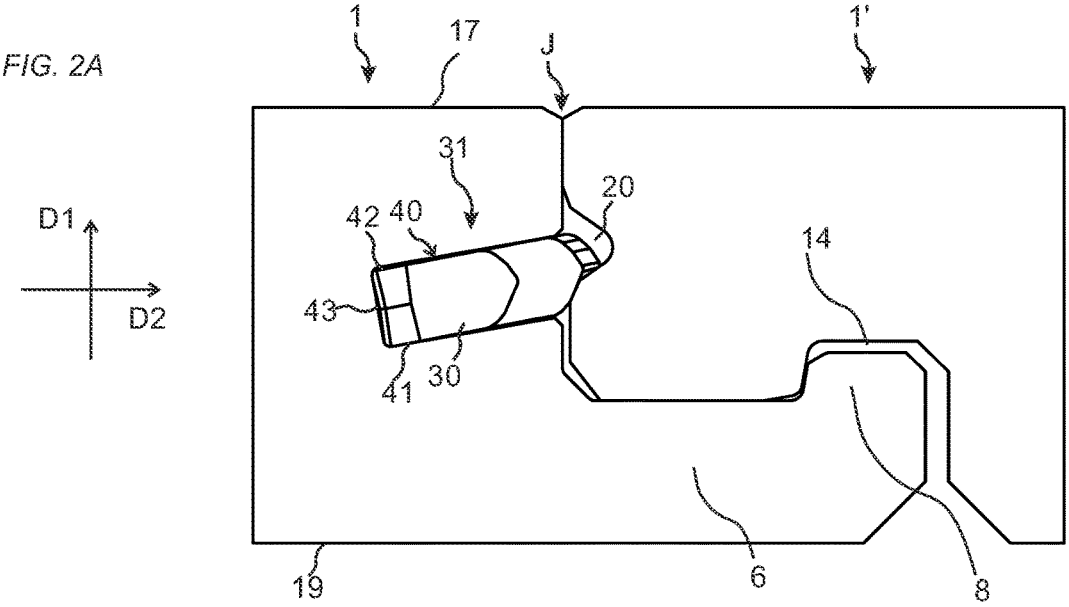
FIGS. 2A-2C show cross sections of an embodiment of the set of panels according to the invention.
Figure 2B:
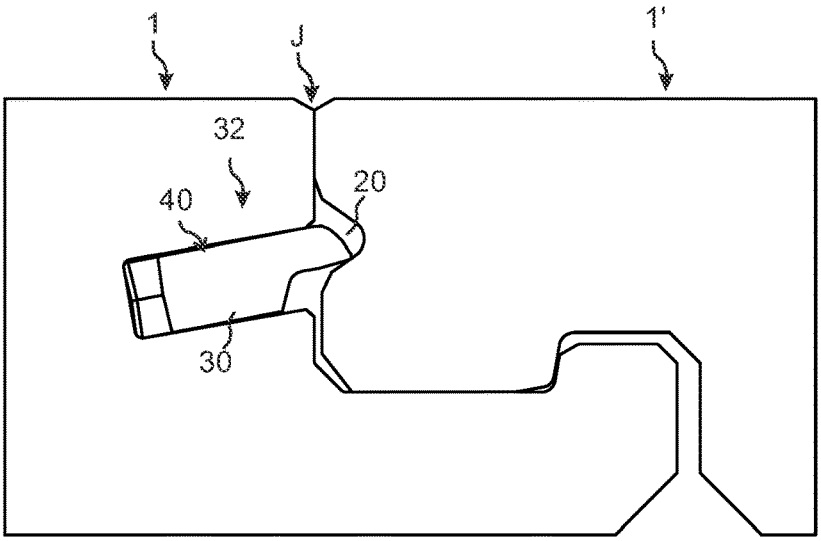
Figure 2C:
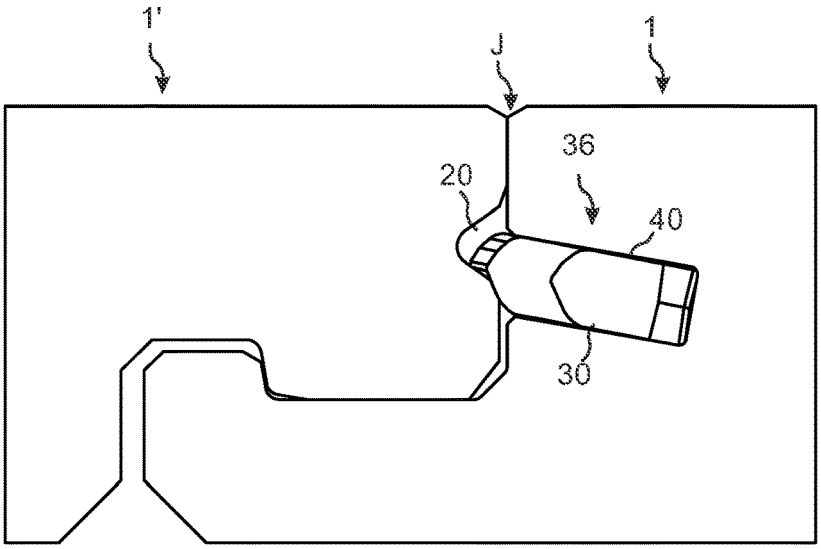

FIG. 2A shows an embodiment at a cross section at the first edge part 31, FIG. 2B shows the embodiment at a cross section at the central part 32, and FIG. 2C shows the embodiment at a cross section at the second edge part 36. The cross section at the second edge part 36 may be a mirror inverted version of the cross section at the first edge part 31. FIGS. 4A and 4B show enlargements of a part of FIGS. 2A and 2B, respectively.

Figure 9A:
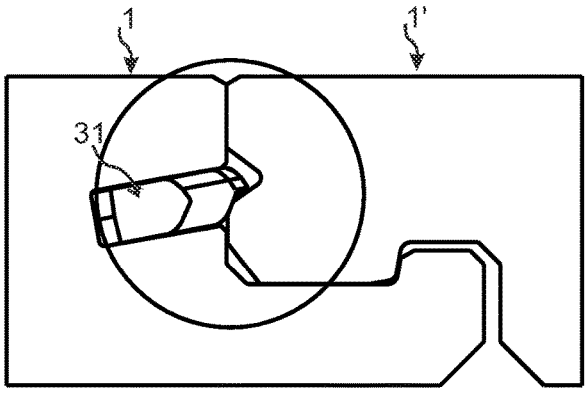
FIG. 9A-9F show a cross section of an embodiment of the set at the first edge part of the tongue during assembling according to the invention.
Figure 9D:
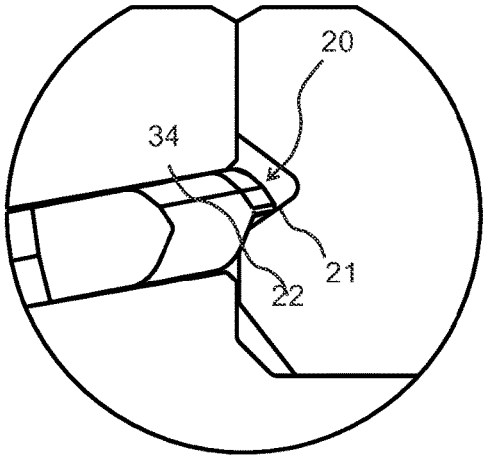
Figure 9B:
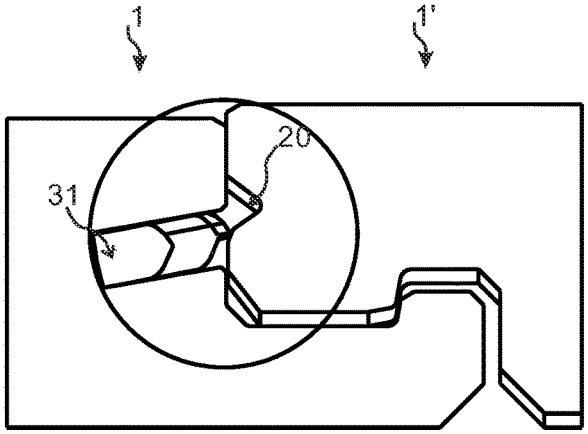
Figure 9E:
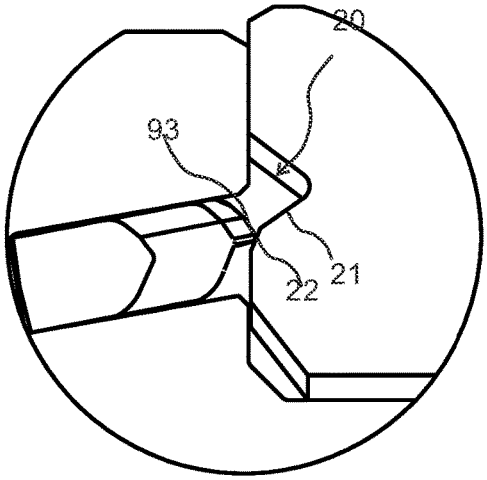

FIG. 4A shows that the embodiment may comprise a tongue guiding surface 34 at the first edge part 31 of flexible tongue which is configured to cooperate with the groove guiding surface 22 of the tongue groove during disassembling, compare FIG. 9E. The tongue guiding surface 34 may be positioned in the locked position at the groove guiding surface 22 which may facilitate disassembling.

The guiding surface 34 may be positioned at a distance from an outermost edge 93 of the flexible tongue at the first edge part.

The outermost edge 93 of the flexible tongue at the first edge part may be configured to cooperate with groove guiding surface during disassembling, compare FIG. 9E.

Figure 9C:
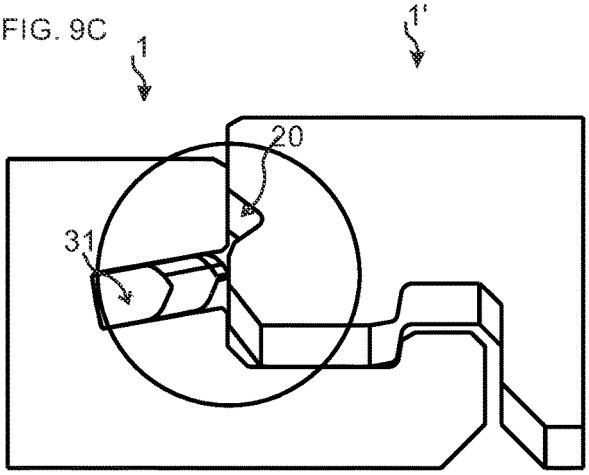
Figure 9F:
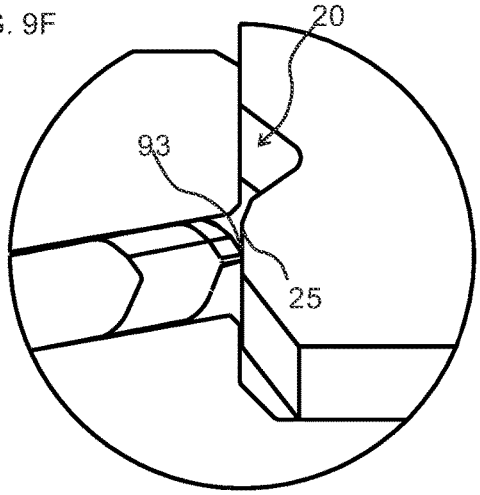

The outermost edge 93 of the flexible tongue at the first edge part may be configured to cooperate with the edge surface 25 during disassembling, compare FIG. 9F.

FIG. 4B shows that the embodiment may comprise at the central part 32 a locking recess 38, which is facing the locking surface 21, and adjacent the locking edge 35.

The locking edge 35 may be adjacent an outermost edge 92 of the flexible tongue at the central part 32.

Figure 10A:
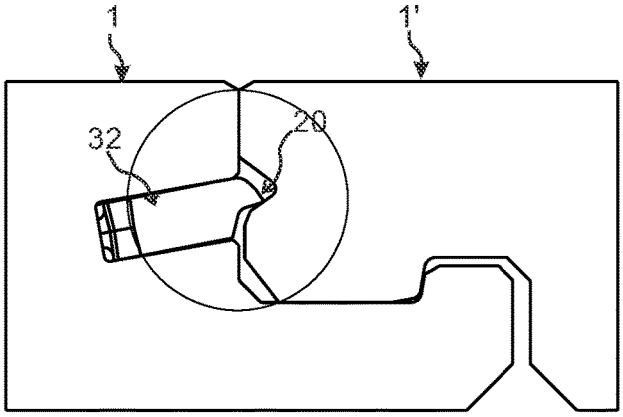
FIG. 10A-10F show a cross section of an embodiment of the set at the central part of the tongue during assembling according to the invention.
Figure 10D:
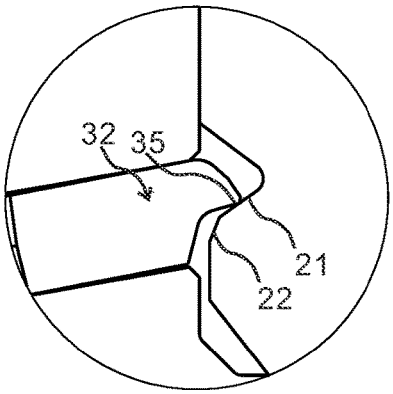
Figure 10B:
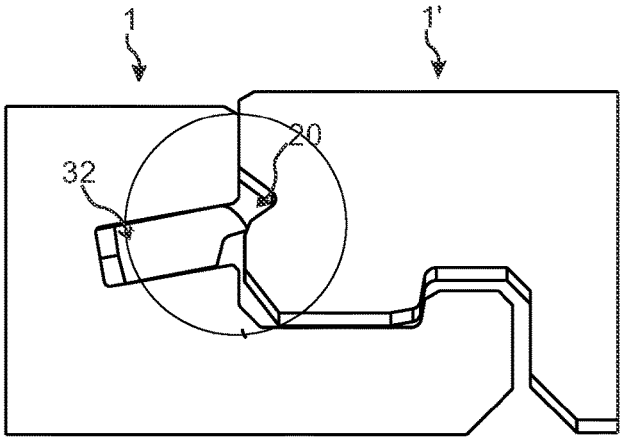
Figure 10E:
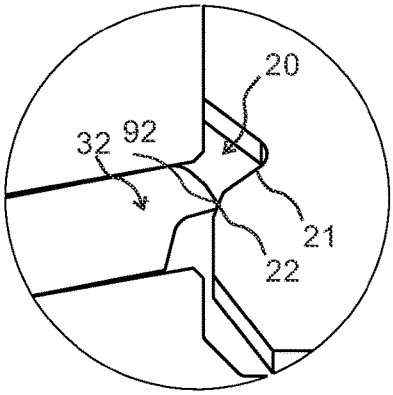

The outermost edge 92 of the flexible tongue at the central part may be configured to cooperate with groove guiding surface 22 during disassembling, compare FIG. 10E.

Figure 10C:
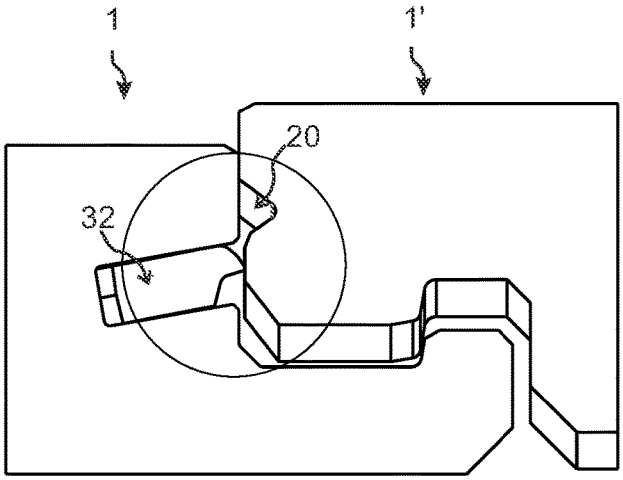
Figure 10F:
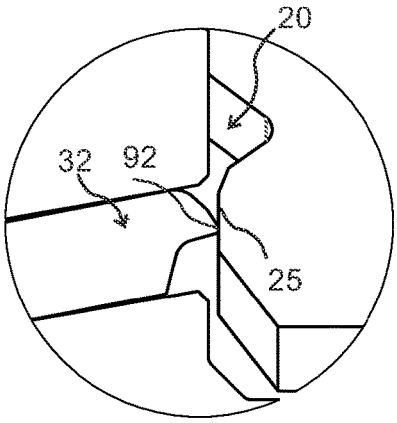

The outermost edge 92 of the flexible tongue at the central part 32 may be configured to cooperate with the edge surface 25 during disassembling, compare FIG. 10F.

FIGS. 9A-9C show the cross section at the first edge part 31 shown in FIG. 2A during disassembling in three consecutive steps. FIGS. 9D-9F show an enlargement of a part in FIGS. 9A-9C, respectively during the same three consecutive steps.

FIGS. 10A-10C show the cross section at the central part 32 shown in FIG. 2B during disassembling in three consecutive steps. FIGS. 10D-10F show an enlargement of a part in FIGS. 10A-10C, respectively, during the same three consecutive steps.

Figure 3A:
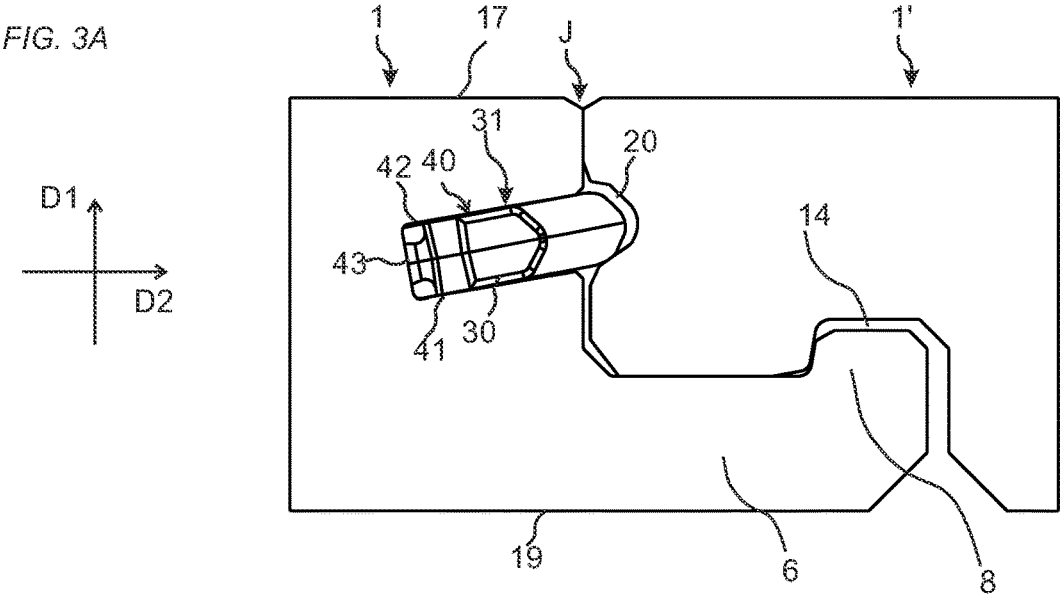
FIGS. 3A-3C show cross sections of an embodiment of the set of panels according to the invention.
Figure 3B:
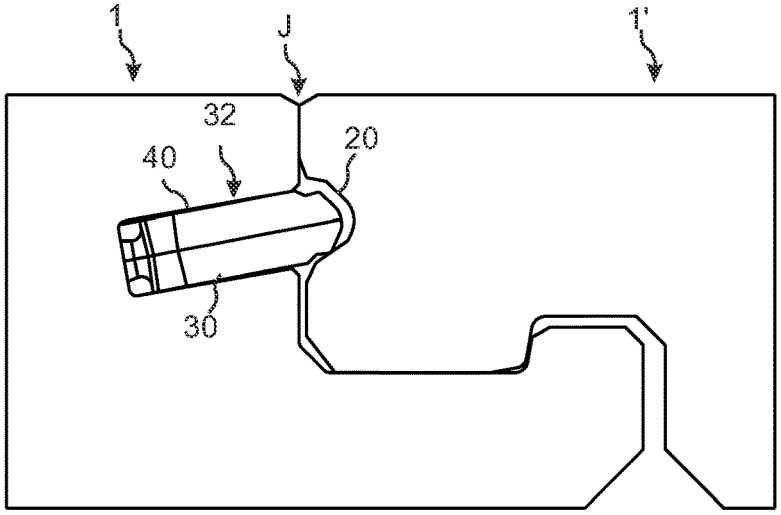
Figure 3C:
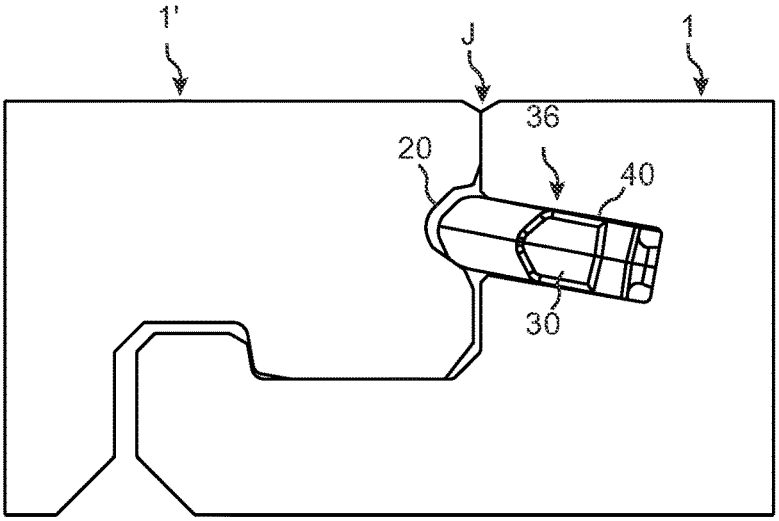

FIG. 3A shows an embodiment at a cross section at the first edge part 31, FIG. 3B shows the embodiment at a cross section at the central part 32, and FIG. 3C shows the embodiment at a cross section at the second edge part 36. The cross section at the second edge part 36 may be a mirror inverted version of the cross section at the first edge part 31. FIGS. 5A and 5B show enlargements of a part of FIGS. 2A and 2B, respectively.

FIG. 5A shows that the embodiment may comprise, at the first edge part 31, of flexible tongue a tongue guiding surface 34 which is configured to cooperate with the groove guiding surface 22 of the tongue groove during disassembling. The guiding surface 34 may be positioned in the locked position at the locking surface 21 and adjacent the groove guiding surface 22.

Figure 11A:
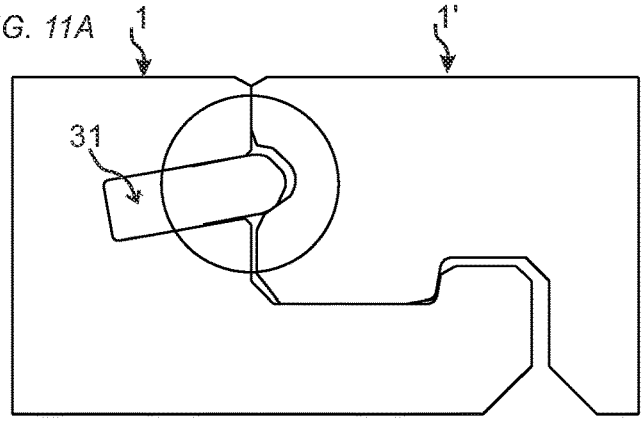
FIG. 11A-11F show a cross section of an embodiment of the set at the first edge part of the tongue during assembling according to the invention.
Figure 11D:
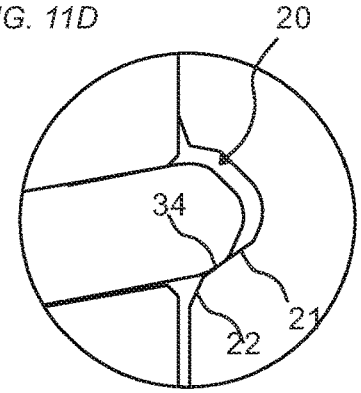
Figure 11B:
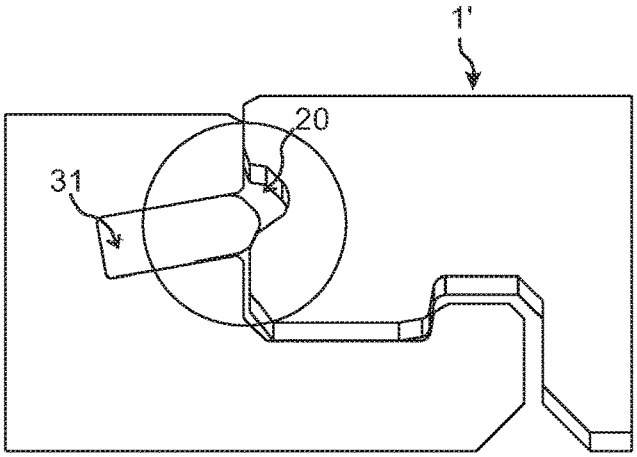
Figure 11E:
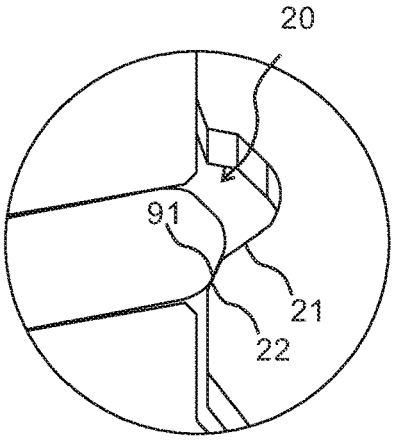

The embodiment may comprise, at the first edge part 31, an outer tongue guiding surface 91 which is configured to cooperate with the groove guiding surface 22 of the tongue groove during disassembling, compare FIG. 11E.

The outer tongue guiding surface 91 may be positioned between an outermost edge 93 of the first edge part and the tongue guiding surface 34.

Figure 11C:
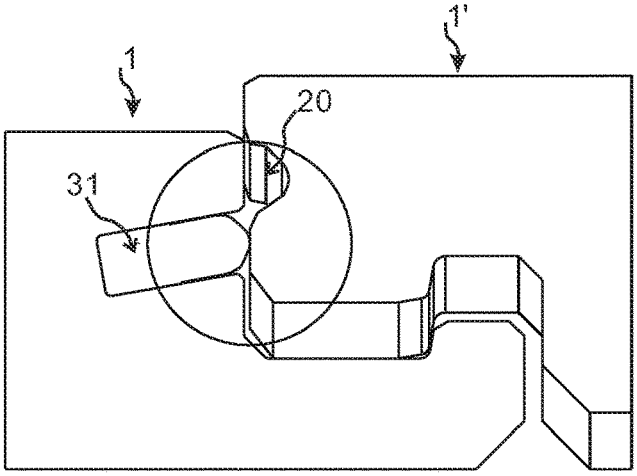
Figure 11F:
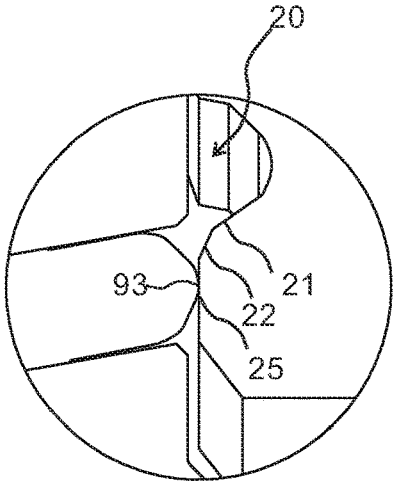

The outermost edge 93 of the flexible tongue at the first edge part may be configured to cooperate with the edge surface 25 during disassembling, compare FIG. 11F.

FIG. 5B shows that the embodiment may comprise, at the central part 32, a locking recess 38, which is facing the locking surface 21, and adjacent the locking edge 35. The embodiment comprises another locking recess 38' at an opposite side of the flexible tongue. The embodiment may have a symmetric cross section which may have the advantage that the flexible tongue may be inserted in the insertion groove in two different orientations and may have the same function in both orientations.

The locking recess 38 may comprise a first recess surface 96 adjacent the locking edge 35 and a second opposite recess surface 98, wherein the first recess surface 96 extends at an acute angle 94 to a centreline 96 of the flexible tongue 30. This may have the effect that the locking strength is increased.

The another locking recess 38' may comprise a first recess surface 96' adjacent the locking edge 35 and a second opposite recess surface 98', wherein the first recess surface 96' extends at an acute angle 95 to a centreline 96 of the flexible tongue 30.

Figure 12A:
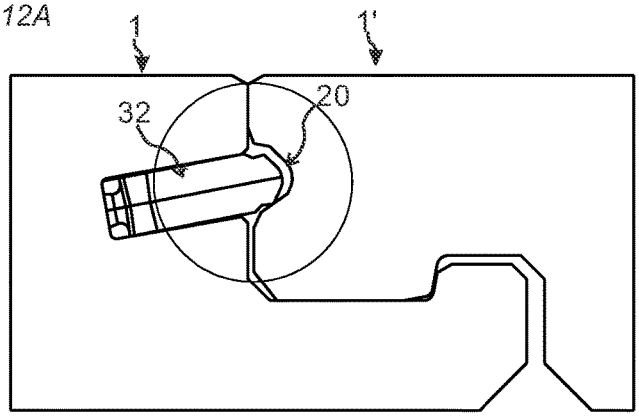
FIG. 12A-12F show a cross section of an embodiment of the set at the central part of the tongue during assembling according to the invention.
Figure 12D:
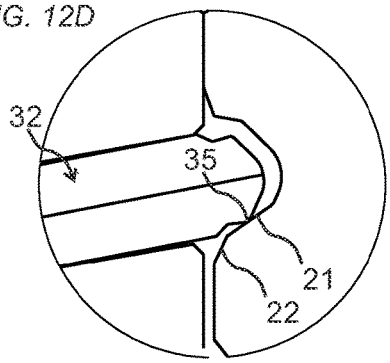
Figure 12B:
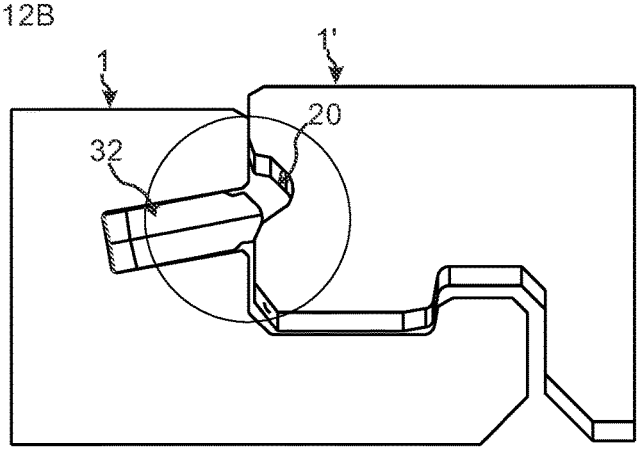
Figure 12E:
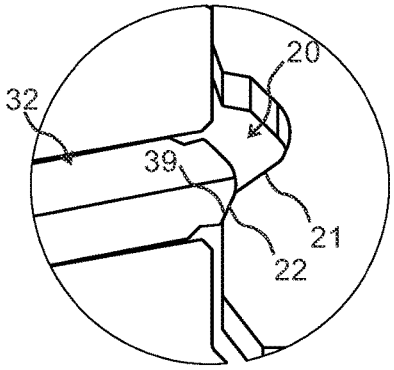

The central part 32 may comprise a tongue guiding surface 39 which is configured to cooperate with the groove guiding surface 22 of the tongue groove during disassembling, compare FIG. 12E. The tongue guiding surface 39 may be positioned between the locking edge 35 and an outermost edge 92 of the central part 32.

Figure 12C:
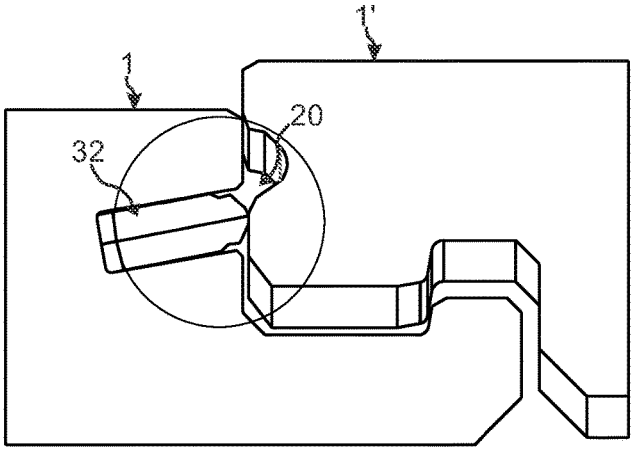
Figure 12F:
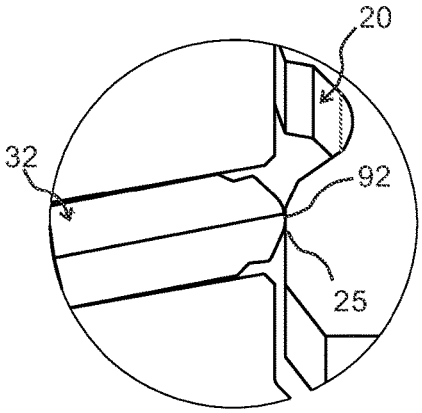

The outermost edge 92 of the central part 32 may be configured to cooperated with the edge surface 25 during disassembling, compare FIG. 12F.

FIGS. 11A-11C show the cross section at the first edge part 31 shown in FIG. 3A during disassembling in three consecutive steps. FIGS. 11D-11F show an enlargement of a part in FIGS. 11A-11C, respectively, during the same three consecutive steps.

FIGS. 12A-12C show the cross section at the central part 32 shown in FIG. 3B during disassembling in three consecutive steps. FIGS. 12D-12F show an enlargement of a part in FIGS. 12A-12C, respectively, during the same three consecutive steps.

Figure 6A:
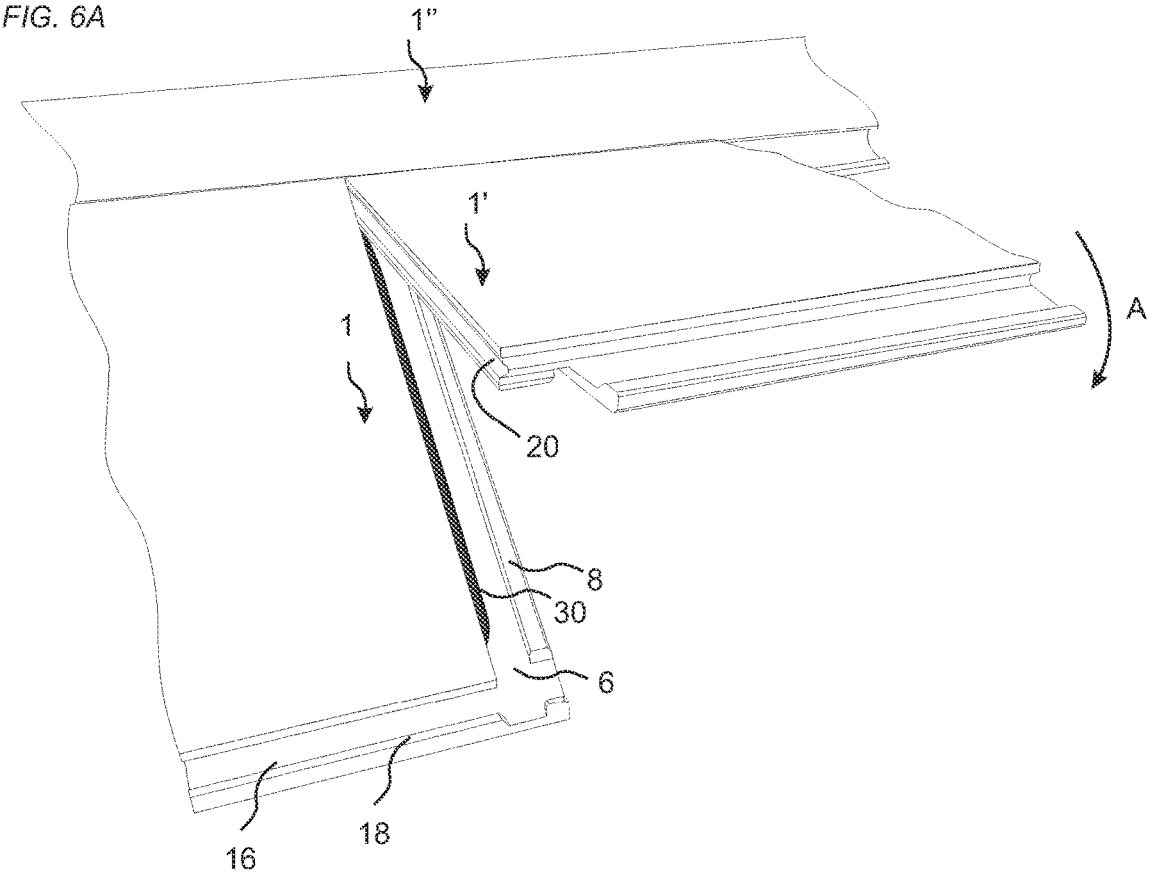
FIG. 6A shows an embodiment of the set during assembling according to of the invention.
Figure 6B:
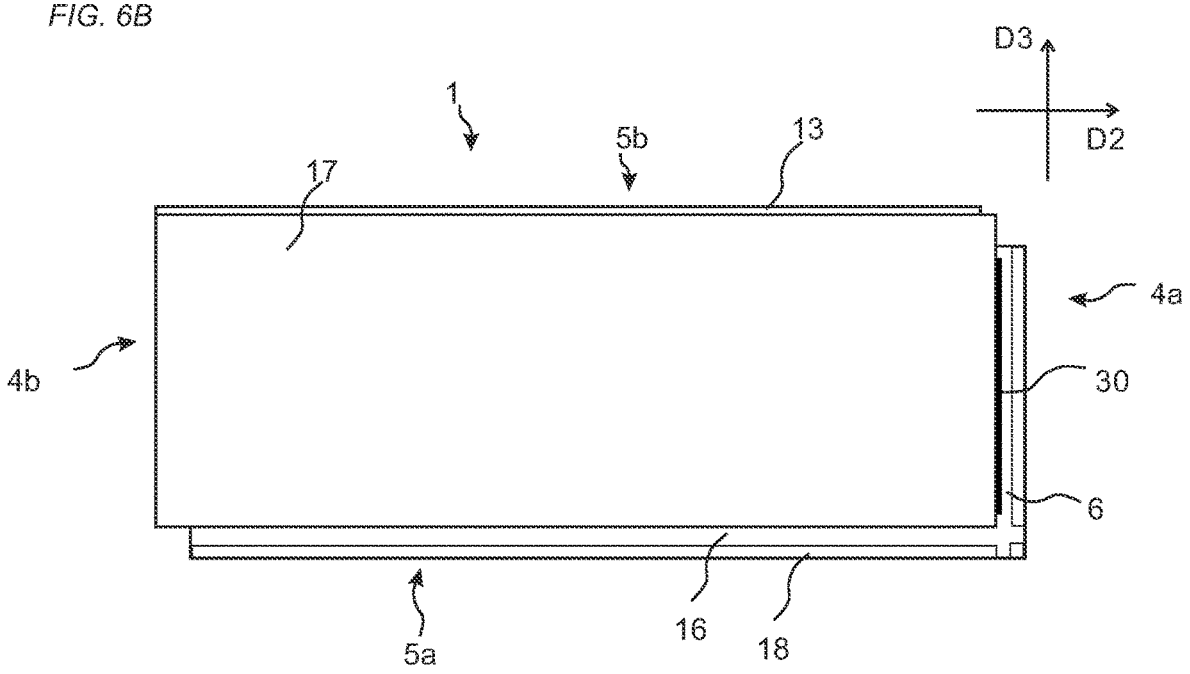
FIG. 6B shows an embodiment of a panel according to the invention.

FIG. 6A-6B show that the mechanical locking device may comprise a second locking strip 16, at the third or the fourth edge 5*a*,5*b*, provided with a second locking element 18 which may be configured to cooperate with a second locking groove 24 at the other of the third or fourth edge 5*a*,5*b* of an adjacent third panel 1''' for a locking in a third direction D3 which is perpendicular to the first direction D1.

The mechanical locking device at the third and the fourth edge may be configured to be assembled by an angling motion A, wherein a tongue 13 at the third or the fourth edge 5*a*,5*b* is positioned in a tongue groove 2 (not shown in FIG. 6A-6B, an embodiment of the tongue groove is shown in FIG. 14B) at the other of the third or the fourth edge 5*a*,5*b* of another panel 1'' in an already installed row.

An embodiment of a method for disassembling of a set of panels, such as building panels, is shown in FIGS. 13 and 14 B-D. The set is shown during disassembling in in 3D views in FIGS. 13 and 14C and in a side view in FIG. 14D shows the set after disassembling.

The method includes a first panel and a second panel each comprising a main surface 17, 17', a first edge, an opposite second edge, a third edge 5*a* which is adjacent, and optionally perpendicular, to the first edge 4*a* and a fourth edge 5*b* which is opposite to the third edge 5*a*. The set comprises a mechanical locking device which is configured to lock the first edge of the first panel to the second edge of the second panel at a joint seam J, wherein the locking device comprises a flexible tongue 30, which is positioned in an insertion groove 40 at the first edge 4*a* of the first panel and a tongue groove 20 at the second edge 4*b* of the second panel 4*b*. The flexible tongue 30 is of an elongated shape and the length direction is parallel to the first edge 4*a*. The flexible tongue comprises a central part 32 between a first edge part 31 and a second edge part 36 of the flexible tongue 30. The central part 32 is configured to cooperate with the tongue groove 20 for locking of the first and the second edge in a first direction D1 which is perpendicular to the main surface in a locked position of the first panel 1 and the second panel 1', wherein the method comprises.

applying a force P' adjacent the first edge 4*a* and adjacent the third edge 5*a* of the first panel, whereby displacing the first edge part 31 towards a bottom surface 43 of the insertion groove 40, and disassembling of the second panel 1' from the first panel 1 by displacing R the third edge 5*a* of the second panel 1' relative the third edge 5*a* of the first panel 1.

The method may further comprise applying another force P adjacent the second edge 4*b* and adjacent the third edge 5*a* of the second panel 1'.

The method may comprise further displacing R the third edge 5*a* of the second panel 1' R relative the third edge 5*a* of the first panel 1 whereby displacing the central part 32 towards the bottom surface 43 of the insertion groove 40 such that the mechanical locking device is unlocked.

The method may comprise applying the force P' and the another force P simultaneously or applying the force P' and the another force P alternately.

The method may comprise applying the force P' and the another force P two or more times.

The first panel and the second panel may be essentially identical.

The method may comprise applying the force P' and the another force P in a direction which is opposite to the first direction D1.

The method may comprise applying the force P' at a distance 77 from the joint seam J and at a distance 78 from an upper and outermost part of the third edge 5*b* of the first panel 1.

The distance 77 from the joint seam J may be in the range of about 5 to about 15 cm or about 10 cm. The distance 78 from the upper and outermost part of the third edge 5*b* of the first panel 1 may be in the range of about 0 cm to about 5 or in the range of about about 0.5 cm to about 2 cm, or about 1 cm. The method may comprise applying the another force P at a distance 75 from the joint seam J and at a distance 76 from an upper and outermost part of the third edge 5*b* of the second panel 1.

The distance 75 from the joint seam J may be in the range of about 5 to about 15 cm or about 10 cm. The distance 76 from the upper and outermost part of the third edge 5*b* of the first panel 1 may be in the range of about 0 cm to about 5 cm or in the range of about about 0.5 cm to about 2 cm, or about 1 cm. The method may comprise bending the first panel 1 around an axis 74 which is parallel to an outermost part of the first edge 4*b* of the first panel when the force P' is applied and/or bending the second panel 1' around an axis 72 which is parallel to an outermost part of the first edge 4*b* of the second when the another force P is applied.

The bending of the first panel may cause a relative displacement of the outermost part of the first edge 4*b* relative the main surface 17 which is in the range of about 0.1 mm to about 0.5 mm, or about 0.2 mm.

The bending of the second panel 1' may cause a relative displacement of the outermost part of the first edge 4*b* relative the main surface 17' which is in the range of about 0.1 mm to about 0.5 mm, or about 0.2 mm.

The method may comprise raising, with a raising element 60, the third edge 5*a* of the second panel 1' or the third edge 5*a* of the first panel 1 (not shown) before applying the force P' and/or the force P. The raising element may facilitate the disassembling when the panels are installed on an even surface. When the panels are assembled on an uneven surface, e.g., on a framework, the raising element may be redundant.

An embodiment of the raising element 60 is shown in FIG. 14A. The raising element may comprise a wedge shaped part 63.

The raising element 60 may comprise an inclined surface 62. The inclination of the inclined surface is adapted to the desired angle of the panel relative a sub-surface in the position in which the force P' and/or the another force P is applied.

The raising element 60 may comprise a protruding positioning element 61. The raising element 60 is in the correct position relative the third edge 5*a* when the positioning element cooperates with the third edge 5*a*.

FIG. 15A-16B shows that the method may comprise bending the first panel 1 around an axis 71 which is parallel to an outermost part of the third edge 5*b* of the second panel 1' when the third edge 5*a* of the second panel 1' is displaced R relative the third edge 5*a* of the first panel 1.

Figure 17A:
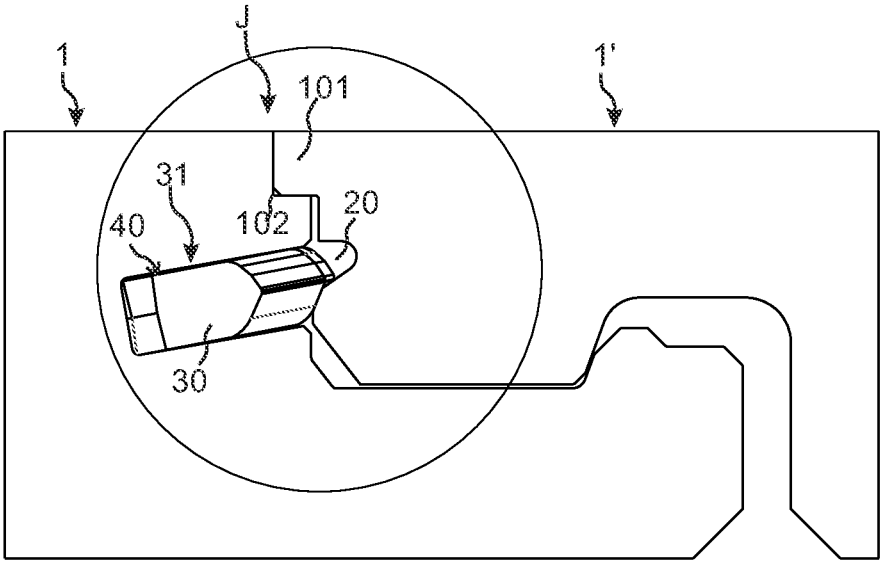
FIGS. 17A-17B show a cross section of an embodiment of the set of panels according to the invention.
Figure 17B:
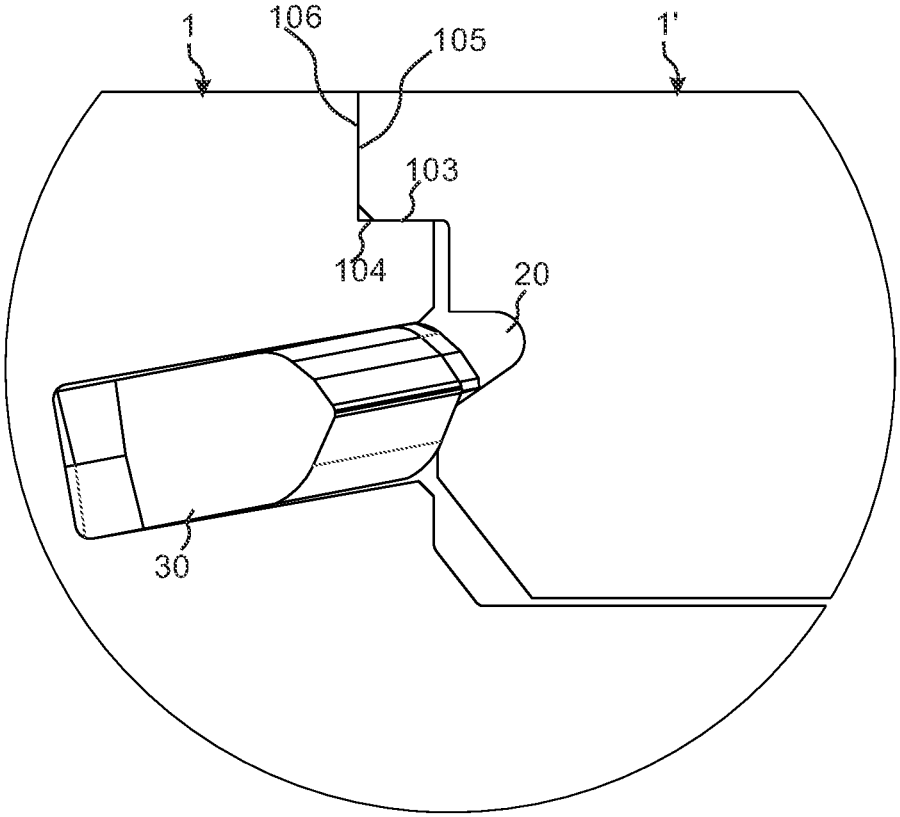

FIG. 17A shows an embodiment of the set and FIG. 17B shows an enlargement of a part of FIG. 17A. The set comprises a recess 102 at an upper edge of the first edge of the first panel. The recess 102 is positioned above the insertion groove 40. The second edge of the second panel 1' comprises at upper edge a protruding element 101 which is configured to cooperate with the recess. The cooperation between the recess 102 and the protruding element 101 may prevent moisture and/or liquid to penetrate into the mechanical locking device.

The recess may have an upper recess surface 106 and a lower recess surface 104 protruding. The protruding element 101 may have an upper element surface 105 and a lower element surface 103. The upper recess surface 106 may be configured to cooperate with the upper element surface 105. The lower recess surface 104 may be configured to cooperate with the lower element surface 103.

Further Embodiments Are Described Below

1. A set of panels, such as building panels, which comprises a first panel 1 and a second panel 1' each comprising a main surface, a first edge 4*a*, an opposite second edge 4*b*, a third edge 5*a* which is adjacent and optionally perpendicular to the first edge 4*a* and a fourth edge 5*b* which is opposite to the third edge 5*a*, wherein the set comprises a mechanical locking device which is configured to lock the first edge of the first panel to the second edge of the second panel at a joint seam J, wherein the locking device comprises a flexible tongue 30, which is positioned in an insertion groove 40 at the first edge 4*a* of the first panel and a tongue groove 20 at the second edge 4*b* of the second panel 4*b*, wherein the flexible tongue 30 is of an elongated shape and the length direction is parallel to the first edge 4*a*, wherein the flexible tongue comprises a central part 32 between a first edge part 31 and a second edge part 36 of the flexible tongue 30, wherein the central part 32 is configured to cooperate with the tongue groove 20 for locking of the first and the second edge in a first direction D1 which is perpendicular to the main surface in a locked position of the first panel 1 and the second panel 1', wherein the first edge part 31 and the tongue groove 20 are configured such that when in the locked position a force P' is applied adjacent the first edge 4*a* and the third edge 5*a* of the first panel and optionally another force P is applied adjacent the second edge 4*b* and the third edge 5*a* of the second panel 1', the first edge part 31 is pushed towards a bottom surface 43 of the insertion groove 40 which allows a disassembling of the second panel 1' from the first panel 1 by displacing R the third edge 5*a* of the second panel 1' relative the third edge 5*a* of the first panel 1.
2. The set as described in embodiment 1, wherein the mechanical locking is configured such that the when the third edge 5*a* of the second panel 1' is displaced R relative the third edge 5*a* of the first panel 1 the central part 32 is pushed towards the bottom surface 43 of the insertion groove 40 such that the mechanical locking device is unlocked.
3. The set as described in embodiment 1 or 2, wherein the first panel and the second panel are essentially identical.
4. The set as described in any one of the preceding embodiments, wherein the force P' and the another force P are applied in a direction which is opposite to the first direction D1.
5. The set as described in any one of the preceding embodiments, wherein the force P' is applied at a distance 77 from the joint seam J and at a distance 78 from an upper and outermost part of the third edge 5*b* of the first panel 1.
6. The set as described in any one of the preceding embodiments, wherein the another force P is applied at a distance 75 from the joint seam J and at a distance 76 from an upper and outermost part of the third edge 5*b* of the second panel 1.
7. The set as described in any one of the preceding embodiments, wherein the first panel 1 is configured to bend around an axis 74 which is parallel to an outermost part of the first edge 4*b* of the first panel when the force P' is applied and/or the second panel 1' is configured to bend around an axis 72 which is parallel to an outermost part of the first edge 4*b* of the second when the another force P is applied.
8. The set as described in any one of the preceding embodiments, wherein the first edge part 31 comprises at a first edge 84 a flexible part 53 and a recess 52, wherein the flexible part is configured to be displaced towards a bottom surface 54 of the recess 52 during assembling and disassembling of the first and the second panel 1, 1', wherein the first edge part 31 comprises at a second edge 83, which is opposite to the first edge, a curved surface 51, wherein an axis of the curved surface 51 is essentially perpendicular to an upper surface 85 of the first edge part 31, wherein the curved surface 51 extends at least partly over the recess 52.
9. The set as described in embodiment 8, wherein the curved surface 51 has in an unlocked position a first length 57 in a length direction of the flexible tongue and when the force P' and the another force P is applied a second length 57' in a length direction of the flexible tongue, wherein the second length 57' is greater than first length 57.

10. The set as described in embodiment 8 or 9, wherein the curved surface 51 in the locked position is configured to be pushed by the flexible part 53 towards the tongue groove 20.
11. The set as described in any one of the embodiments 8-10, wherein the first edge part 31 comprises a protruding part 87 adjacent the curved surface 51.
12. The set as described in any one of the preceding embodiments 8-11, wherein the first edge part 31 comprises at a first edge 84 a guiding surface 34 which is configured to cooperate with the tongue groove when the force P' and the another force P are applied such that the second edge 83 of the first edge part 31 is displaced toward the insertion groove 40.
13. The set as described in embodiment 12, wherein the flexible tongue 30 is configured to bend in the length direction when the second edge is displaced towards the insertion groove 40 such that a bent tongue part is obtained with a bent outer edge which may be configured as a guiding surface which cooperates with the tongue 20 groove and/or an edge surface 25 of the second panel such that the central part 32 is pushed towards the bottom surface 43 of the insertion groove 40 and the mechanical locking device is unlocked.
14. The set as described in any one of the preceding embodiments, wherein the central part 32 comprises at a first edge 84' a flexible part 53' and a recess 52', wherein the flexible part is configured to be displaced towards a bottom surface 54 of the recess 52 during assembling and disassembling of the first and the second panel 1, 1', wherein a wherein the first central part 32 comprises at a second edge 83', which is opposite to the first edge, an essentially straight surface 55, wherein the second edge 83' is configured to cooperate with the tongue groove 20 for the locking of the first and the second edge in the first direction D1.
15. The set as described in embodiment 14, wherein the second edge 83' of the central part 32 comprises a locking edge 35 which is configured to cooperate with a locking surface 21 of the tongue groove 20 for the locking of the first and the second edge in the first direction D1.
16. The set as described in embodiment 15, wherein the second edge 83' of the central part 32 comprises a locking recess 38 adjacent the locking edge 35.
17. The set as described in embodiment 16, wherein the locking recess 38 comprises a first recess surface 96 adjacent the locking edge 35 and a second recess surface 98, wherein the first recess surface 96 extends at an acute angle 94 to a centreline 96 of the flexible tongue 30.
18. The set as described in any one of the preceding embodiments, wherein the first panel 1 is configured to bend around an axis 71 which is parallel to an outermost part of the third edge 5*b* of the second panel 1' when the third edge 5*a* of the second panel 1' is displaced R relative the third edge 5*a* of the first panel 1.
19. The set as described in any one of the preceding embodiments, wherein the thickness of the panels is in the range of about 3 mm to about 15 mm, and preferably in the range of about 4 mm to about 8 mm.
20. The set as described in any one of the preceding embodiments, wherein the mechanical locking device comprises a first locking strip 6, at the first edge 4*a* or at the opposite second edge 4*b*, provided with a first locking element 8 which is configured to cooperate with a first locking groove 14 at the other of the first or the second edge 4*a*,4*b* for a locking in a second direction D2 which is perpendicular to the first direction D1.
21. The set as described in any one of the preceding embodiments, wherein the mechanical locking device comprises a second locking strip 16, at the third or the fourth edge 5*a*,5*b*, provided with a second locking element 18 which is configured to cooperate with a second locking groove 24 at the other of the third or fourth edge 5*a*,5*b* of an adjacent third panel 1''' for a locking in a third direction D3 which is perpendicular to the first direction D1.
22. The set as described in embodiment 21, wherein the mechanical locking device at the third and the fourth edge is configured for an assembling and/or a disassembling by an angling motion, wherein a tongue 13 at the third or the fourth edge 5*a*,5*b* is positioned in a tongue groove 2 at the other of the third or the fourth edge 5*a*,5*b*.
23. A flexible tongue 30 which is configured to lock a first edge 4*a* of a first panel 1 to a second edge 4*b* of a second panel 1' wherein the flexible tongue 30 is configured to be positioned in an insertion groove 40 at the first edge 4*a* of the first panel and to cooperate with a tongue groove 20 at the second edge 4*b* of the second panel 4*b*, wherein the flexible tongue 30 is of an elongated shape and the length direction is parallel to the first edge 4*a*, wherein the flexible tongue comprises a central part 32 between a first edge part 31 and a second edge part 36 of the flexible tongue 30, wherein the central part 32 is configured to cooperate with the tongue groove 20 for the locking of the first and the second edge wherein the first edge part 31 comprises at a first edge 84 a flexible part 53 and a recess 52, wherein the flexible part is configured to be displaced towards a bottom surface 54 of the recess 52 during assembling and disassembling of the first and the second panel 1, 1', wherein the first edge part 31 comprises at a second edge 83, which is opposite to the first edge, a curved surface 51, wherein an axis of the curved surface 51 is essentially perpendicular to an upper surface 85 of the first edge part 31, wherein the curved surface 51 extends at least partly over the recess 52.
24. The flexible tongue 30 as described in embodiment 23, wherein the curved surface 51 has in an unlocked position a first length 57 in a length direction of the flexible tongue and during disassembling a second length 57' in a length direction of the flexible tongue, wherein the second length 57' is greater than first length 57.
25. The flexible tongue 30 as described in embodiment 23 or 24, wherein the curved surface 51 in the locked position is configured to be pushed by the flexible part 53 towards the tongue groove 20.
26. The flexible tongue 30 as described in any one of the preceding embodiments 23-25, wherein the first edge part 31 comprises at a first edge 84 a guiding surface 34 which is configured to cooperate with the tongue groove when the force P' and the another force P are applied such that the second edge 83 is displaced towards the insertion groove 40.
27. The flexible tongue 30 as described in embodiment 26, wherein the flexible tongue 30 is configured to bend in the length direction when the second edge of the 83 first edge part 31 is displaced towards the insertion groove 40 such that a bent tongue part is obtained with a bent outer edge which may be configured as a guiding surface which cooperates with the tongue groove 20 and/or an edge surface 25 of the second panel 1' such that the central part 32 is pushed towards the bottom surface 43 of the insertion groove 40 and the mechanical locking device is unlocked.

28. The flexible tongue 30 as described in any one of the preceding embodiments 23-27, wherein the central part 32 comprises at a first edge 84' a flexible part 53' and a recess 52', wherein the flexible part is configured to be displaced towards a bottom surface 54 of the recess 52 during assembling and disassembling of the first and the second panel 1, 1', wherein the first central part 32 comprises at a second edge 83', which is opposite to the first edge, an essentially straight surface 55, wherein the second edge 83' is configured to cooperate with the tongue groove 20 for the locking of the first and the second edge in the first direction D1.

29. The flexible tongue 30 as described in embodiment 28, wherein the second edge 83' of the central part 32 comprises a locking edge 35 which is configured to cooperate with a locking surface 21 of the tongue groove 20 for the locking of the first and the second edge in the first direction D1.

30. The flexible tongue 30 as described in embodiment 29, wherein the second edge 83' of the central part 32 comprises a locking recess 38 adjacent the locking edge 35.

31. The flexible tongue 30 as described in embodiment 30, wherein the locking recess 38 comprises a first recess surface 96 adjacent the locking edge 35 and a second recess surface 98, wherein the first recess surface 96 extends at an acute angle 94 to a centreline 96 of the flexible tongue 30.

32. A method for disassembling a set of panels, such as building panels, which comprises a first panel 1 and a second panel 1' each comprising a main surface, a first edge 4*a*, an opposite second edge 4*b*, a third edge 5*a* which is adjacent and optionally perpendicular to the first edge 4*a* and a fourth edge 5*b* which is opposite to the third edge 5*a*, wherein the set comprises a mechanical locking device which is configured to lock the first edge of the first panel to the second edge of the second panel at a joint seam J, wherein the locking device comprises a flexible tongue 30, which is positioned in an insertion groove 40 at the first edge 4*a* of the first panel and a tongue groove 20 at the second edge 4*b* of the second panel 4*b*, wherein the flexible tongue 30 is of an elongated shape and the length direction is parallel to the first edge 4*a*, wherein the flexible tongue comprises a central part 32 between a first edge part 31 and a second edge part 36 of the flexible tongue 30, wherein the central part 32 is configured to cooperate with the tongue groove 20 for locking of the first and the second edge in a first direction D1 which is perpendicular to the main surface in a locked position of the first panel 1 and the second panel 1', wherein the method comprises applying a force P' adjacent the first edge 4*a* and adjacent the third edge 5*a* of the first panel, applying another force P adjacent the second edge 4*b* and adjacent the third edge 5*a* of the second panel 1', whereby displacing the first edge part 31 towards a bottom surface 43 of the insertion groove 40, and disassembling of the second panel 1' from the first panel 1 by displacing R the third edge 5*a* of the second panel 1' relative the third edge 5*a* of the first panel 1.

33. The method as described in embodiment 32, wherein the method comprises further displacing R the third edge 5*a* of the second panel 1' R relative the third edge 5*a* of the first panel 1 whereby displacing the central part 32 towards the bottom surface 43 of the insertion groove 40 such that the mechanical locking device is unlocked.

34. The method as described in embodiments 32 or 33, comprising applying the force P' and the another force P simultaneously or applying the force P' and the another force P alternately.

35. The method as described in any one of embodiments 32-34, comprising applying the force P' and the another force P two or more times.

36. The method as described in any one of embodiments 32-35, wherein the first panel and the second panel are essentially identical.

37. The method as described in any one of embodiments 32-36, wherein the force P' and the another force P are applied in a direction which is opposite to the first direction D1.

38. The method as described in any one of embodiments 32-37, wherein the force P' is applied at a distance 77 from the joint seam J and at a distance 78 from an upper and outermost part of the third edge 5*b* of the first panel 1.

39. The method as described in any one of embodiments 32-38, wherein the force P' is applied at a distance 75 from the joint seam J and at a distance 76 from an upper and outermost part of the third edge 5*b* of the second panel 1.

40. The method as described in any one of embodiments 32-39, wherein the first panel 1 is configured to bend around an axis 74 which is parallel to an outermost part of the first edge 4*b* of the first panel when the force P' is applied and/or the second panel 1' is configured to bend around an axis 72 which is parallel to an outermost part of the first edge 4*b* of the second when the force P' is applied.

41. The method as described in any one of embodiments 32-40, wherein the first panel 1 is configured to bend around an axis 71 which is parallel to an outermost part of the third edge 5*b* of the second panel 1' when the third edge 5*a* of the second panel 1' is displaced R relative the third edge 5*a* of the first panel 1.

Although the present inventive concept has been described and illustrated in detail, it is clearly understood that the same is by way of illustration and example only and is not to be taken by way of limitation, the spirit and scope of the present inventive concept being limited only by the terms of the appended claims.

The invention claimed is:

1. A set of panels comprising:

a first panel and a second panel each comprising a main surface, a first edge, an opposite second edge, a third edge which is adjacent and optionally perpendicular to the first edge, and a fourth edge which is opposite to the third edge, wherein the panels are floorboards; and a mechanical locking device configured to lock the first edge of the first panel to the second edge of the second panel at a joint seam, wherein the locking device comprises a flexible tongue positioned in an insertion groove at the first edge of the first panel and a tongue groove at the second edge of the second panel, wherein the flexible tongue is of an elongated shape along a length direction parallel to the first edge, wherein the flexible tongue comprises a central part between a first edge part and a second edge part of the flexible tongue, wherein the central part is configured to cooperate with the tongue groove for locking of the first and the second edge in a first direction which is perpendicular to the main surface in a locked position of the first panel and the second panel, wherein the first edge part and the tongue groove are configured such that, when in the locked position, a force is applied adjacent the first edge and the third edge of the first panel, the first edge part is pushed towards a bottom surface of the insertion groove which allows a disassembling of the second panel from the first panel by displacing the third edge of the second panel relative the third edge of the first panel.

2. The set as claimed in claim 1, wherein the mechanical locking device is configured such that, when the third edge of the second panel is displaced relative the third edge of the first panel, the central part is pushed towards the bottom surface of the insertion groove such that the mechanical locking device is unlocked.

3. The set as claimed in claim 1, wherein the first panel and the second panel are essentially identical.

4. The set as claimed in claim 1, wherein the force and the another force are applied in a direction which is opposite to the first direction.

5. The set as claimed in claim 1, wherein the force is applied at a distance from the joint seam and at a distance from an upper and outermost part of the third edge of the first panel.

6. The set as claimed in claim 1, wherein another force is applied at a distance from the joint seam and at a distance from an upper and outermost part of the third edge of the second panel.

7. The set as claimed in claim 1, wherein the first panel is configured to bend around an axis which is parallel to an outermost part of the first edge of the first panel when the force is applied and/or the second panel is configured to bend around an axis which is parallel to an outermost part of the first edge of the second panel when the another force is applied.

8. The set as claimed in claim 1, wherein the first edge part comprises at a first tongue edge a flexible part and a recess, wherein the flexible part is configured to be displaced towards a bottom surface of the recess during assembling and disassembling of the first and the second panel to bias the flexible tongue in an insertion direction from the insertion groove toward the tongue groove, wherein the first edge part comprises a curved surface at a second tongue edge, which is opposite to the first tongue edge in the insertion direction, wherein an axis of the curved surface is essentially perpendicular to an upper surface of the first edge part, wherein the curved surface extends at least partly over the recess.

9. The set as claimed in claim 8, wherein the curved surface has, in an unlocked position, a first length in a length direction of the flexible tongue, wherein the curved surface has, when the force and the another force is applied, a second length in a length direction of the flexible tongue, and wherein the second length is greater than first length.

10. The set as claimed in claim 8, wherein the curved surface in the locked position is configured to be pushed by the flexible part towards the tongue groove.

11. The set as claimed in claim 8, wherein the first edge part comprises a protruding part adjacent the curved surface.

12. The set as claimed in claim 8, wherein the first edge part comprises, at the first tongue edge, a guiding surface which is configured to cooperate with the tongue groove when the force and the another force are applied such that the second tongue edge is displaced toward the insertion groove.

13. The set as claimed in claim 12, wherein the flexible tongue is configured to bend in the length direction when the second tongue edge is displaced towards the insertion groove such that a bent tongue part is obtained with a bent outer edge configured as a guiding surface which cooperates with the tongue groove and/or an edge surface of the second panel such that the central part is pushed towards the bottom surface of the insertion groove and the mechanical locking device is unlocked.

14. The set as claimed in claim 1, wherein the central part comprises at a first tongue edge a flexible part and a recess, wherein the flexible part is configured to be displaced towards a bottom surface of the recess during assembling and disassembling of the first and the second panel, wherein a first central part comprises at a second tongue edge, which is opposite to the first tongue edge, an essentially straight surface, wherein the second tongue edge is configured to cooperate with the tongue groove for the locking of the first and the second edge in the first direction.

15. The set as claimed in claim 14, wherein the second tongue edge, at the central part, comprises a locking edge which is configured to cooperate with a locking surface of the tongue groove for the locking of the first and the second edge in the first direction.

16. The set as claimed in claim 15, wherein the second tongue edge at the central part comprises a locking recess adjacent the locking edge.

17. The set as claimed in claim 16, wherein the locking recess comprises a first recess surface adjacent the locking edge and a second recess surface, wherein the first recess surface extends at an acute angle to a center line of the flexible tongue.

18. The set as claimed in claim 1, wherein the first panel is configured to bend around an axis which is parallel to an outermost part of the third edge of the second panel when the third edge of the second panel is displaced relative the third edge of the first panel.

19. The set as claimed in claim 1, wherein each of the first and the second panel comprises a wood-based core.

20. The set as claimed in claim 1, wherein each of the first and the second panel comprises a core comprising a polymer material.

* * * * *